US011041470B2

(12) United States Patent
Kato et al.

(10) Patent No.: US 11,041,470 B2
(45) Date of Patent: Jun. 22, 2021

(54) CONTROL SYSTEM FOR INTERNAL COMBUSTION ENGINE, AND INTERNAL COMBUSTION ENGINE

(71) Applicant: TOYOTA JIDOSHA KABUSHIKI KAISHA, Toyota (JP)

(72) Inventors: Daiki Kato, Toyota (JP); Ryusuke Kuroda, Nagoya (JP); Masanao Idogawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 16/840,529

(22) Filed: Apr. 6, 2020

(65) Prior Publication Data

US 2020/0325867 A1 Oct. 15, 2020

(30) Foreign Application Priority Data

Apr. 10, 2019 (JP) ..... JP2019-074836

(51) Int. Cl.

| | |
|---|---|
| ***F02M 59/10*** | (2006.01) |
| ***F02D 41/00*** | (2006.01) |
| ***F02M 59/22*** | (2006.01) |
| ***F02M 61/14*** | (2006.01) |

(52) U.S. Cl.

CPC ..... *F02M 59/10* (2013.01); *F02D 41/009* (2013.01); *F02M 59/22* (2013.01); *F02M 61/14* (2013.01)

(58) Field of Classification Search

CPC ..... F02M 59/10; F02M 59/22; F02M 61/14; F02M 65/00; F02D 41/009; F02D 41/062; F02D 41/3094; F02D 41/3845; F02D 2250/06; F02D 2041/0092; F02D 2041/0095; F02D 2250/14; F02D 2250/31; F02D 2200/0604; F02D 45/00

See application file for complete search history.

(56) References Cited

U.S. PATENT DOCUMENTS

2018/0112610 A1* 4/2018 Suzuki ..... F02D 41/40
2018/0230959 A1* 8/2018 Hayashima ..... F02P 5/1504

FOREIGN PATENT DOCUMENTS

JP 2006-057524 3/2006
JP 2013-092116 5/2013

* cited by examiner

*Primary Examiner* — Xiao En Mo
(74) *Attorney, Agent, or Firm* — Finnegan, Henderson, Farabow, Garrett & Dunner, LLP

(57) ABSTRACT

A control system includes a controller. The controller estimates the swing-back amount indicating the turning amount of the crankshaft in the reverse rotation direction until the crankshaft stops. The controller calculates a stop-time counter value which is a value of a crank counter at the time when the engine is stopped based on a final counter value which is the value of the crank counter calculated last before the crankshaft stops and the estimated swing-back amount. The controller corrects the swing-back amount used for calculating the stop-time counter value based on a difference between the number of driving times calculated with reference to the map based on the calculated stop-time counter value and the value of the crank counter and the number of driving times calculated by increasing the number of driving times by one each time the high pressure system fuel pressure increases by the threshold or more.

6 Claims, 12 Drawing Sheets

CONTROL SYSTEM FOR INTERNAL COMBUSTION ENGINE, AND INTERNAL COMBUSTION ENGINE

CROSS-REFERENCE TO RELATED APPLICATION

This application claims priority to Japanese Patent Application No. 2019-074836 filed on Apr. 10, 2019, incorporated herein by reference in its entirety.

BACKGROUND

1. Technical Field

The disclosure relates to a control system for an internal combustion engine, and the internal combustion engine.

2. Description of Related Art

Japanese Unexamined Patent Application Publication No. 2013-092116 (JP 2013-092116 A) discloses a controller for an internal combustion engine that stores a crank angle at the time when an engine is stopped and performs control at the time when the engine is started based on the stored crank angle. At the time when the engine is stopped, a crankshaft may swing in the reverse rotation direction due to the reaction force of the air compressed in a cylinder to recover.

JP 2013-092116 A describes the controller that calculates turning amount of the crankshaft in the reverse rotation direction, that is, swing-back amount, based on reverse flow amount of the air detected by an air flow meter that can detect the forward flow and the reverse flow separately. Then, the crank angle at the time when the engine is stopped is calculated by reflecting the swing-back amount.

SUMMARY

Incidentally, since a detection value of the air flow meter does not directly correspond to the turning amount of the crankshaft, there is a possibility that a deviation occurs between the swing-back amount estimated by the method described in JP 2013-092116 A and actual swing-back amount of the crankshaft. In addition, not only in the case of being estimated by the method of calculating the swing-back amount based on the reverse flow amount of the air, but also in the case where the estimated swing-back amount has the deviation from the actual swing-back amount, the crank angle at the time when the engine is stopped cannot be correctly estimated and control at the time when the engine is started can be adversely affected.

A first aspect of the disclosure relates to a control system for an internal combustion engine including a high pressure fuel pump and an in-cylinder fuel injection valve. The high pressure fuel pump is configured such that a volume of a fuel chamber is increased and is decreased and fuel is pressurized by a reciprocating motion of a plunger due to an action of a pump cam that rotates in conjunction with a rotation of a crankshaft. The in-cylinder fuel injection valve is configured to inject the fuel into a cylinder. The control system includes a controller. The controller is configured to calculate a crank counter that is counted up at every fixed crank angle when the crankshaft is rotating in a forward rotation direction. The controller is configured to estimate the swing-back amount indicating the turning amount of the crankshaft in the reverse rotation direction until the crankshaft stops. The controller is configured to calculate a stop-time counter value which is a value of the crank counter at the time when the internal combustion engine is stopped based on a final counter value which is the value of the crank counter calculated last before the crankshaft stops and the estimated swing-back amount. The controller is configured to store a map in which a top dead center of the plunger is associated with the value of the crank counter. The controller is configured to calculate the number of driving times of the high pressure fuel pump with reference to the map based on the calculated stop-time counter value and the value of the crank counter. The controller is configured to calculate the number of driving times of the high pressure fuel pump by increasing the number of driving times by one each time a high pressure system fuel pressure which is a pressure of the fuel supplied to the in-cylinder fuel injection valve increases by a threshold or more. The controller is configured to correct the swing-back amount used for calculating the stop-time counter value based on a difference between the number of driving times calculated based on the calculated stop-time counter value and the value of the crank counter and the number of driving times calculated by increasing the number of driving times by one each time the high pressure system fuel pressure increases by the threshold or more.

When there is the difference between the number of driving times calculated based on the stop-time counter value and the value of the crank counter, and the number of driving times calculated based on the high pressure system fuel pressure, since the estimated swing-back amount has the difference from the actual swing-back amount, the stop-time counter value can have the difference from the value corresponding to the crank angle at which the crankshaft was actually stopped.

With the above configuration, based on the difference between the number of driving times calculated based on the stop-time counter value and the value of the crank counter and the number of driving times calculated based on the high pressure system fuel pressure, the swing-back amount used for calculating the stop-time counter value is corrected. That is, comparing to a calculation result of calculating the number of driving times using the stop-time counter value with a calculation result of calculating the number of driving times without using the stop-time counter value, based on the result, feedback control is executed to correct the swing-back amount used for calculating the stop-time counter value. Therefore, it is possible to suppress a situation that the control is continued with the difference between the swing-back amount used for calculating the stop-time counter value and the actual swing-back amount.

In the control system according to the first aspect, the controller may be configured to further reduce the swing-back amount used for calculating the stop-time counter value when the number of driving times calculated based on the calculated stop-time counter value and the value of the crank counter is more than the number of driving times calculated by increasing the number of driving times by one each time the high pressure system fuel pressure increases by the threshold or more.

When the number of driving times calculated based on the stop-time counter value and the value of the crank counter is more than the number of driving times calculated based on the high pressure system fuel pressure, the estimated swing-back amount may have been too large.

With the above configuration, when the number of driving times calculated based on the calculated stop-time counter value and the value of the crank counter is more than the number of driving times calculated based on the high pressure system fuel pressure, it is possible to suppress a case that a situation in which the swing-back amount used for calculating the stop-time counter value is too large continues to further reduce the swing-back amount used for calculating the stop-time counter value.

In the control system according to the first aspect, the controller may be configured to further increase the swing-back amount used for calculating the stop-time counter value when the number of driving times calculated based on the calculated stop-time counter value and the value of the crank counter is less than the number of driving times calculated by increasing the number of driving times by one each time the high pressure system fuel pressure increases by the threshold or more.

When the number of driving times calculated based on the stop-time counter value and the value of the crank counter is less than the number of driving times calculated based on the high pressure system fuel pressure, the estimated swing-back amount may have been too small.

With the above configuration, when the number of driving times calculated based on the stop-time counter value and the value of the crank counter is less than the number of driving times calculated based on the high pressure system fuel pressure, it is possible to suppress a case that a situation in which the swing-back amount used for calculating the stop-time counter value is too small continues to further increase the swing-back amount used for calculating the stop-time counter value.

In the control system according to the first aspect, the controller may be configured to correct the swing-back amount used for calculating the stop-time counter value by an amount needed to eliminate the difference between the number of driving times calculated based on the calculated stop-time counter value and the value of the crank counter and the number of driving times calculated by increasing the number of driving times by one each time the high pressure system fuel pressure increases by the threshold or more.

In the above configuration, the correction is performed in accordance with the amount needed to eliminate the difference between the number of driving times calculated based on the calculated stop-time counter value and the value of the crank counter and the number of driving times calculated based on the high pressure system fuel pressure, and the correction amount is kept to a needed minimum range. For example, when the number of driving times calculated based on the calculated stop-time counter value and the value of the crank counter is one more than the number of driving times calculated based on the high pressure system fuel pressure, the correction is performed by the minimum amount needed to reduce the number of driving times calculated by one based on the calculated stop-time counter value and the value of the crank counter.

Therefore, according to the above configuration, the difference between the number of driving times calculated based on the calculated stop-time counter value and the value of the crank counter and the number of driving times calculated based on the high pressure system fuel pressure can be eliminated while excessive correction is suppressed.

In the control system according to the first aspect, the controller is configured to have a first map in which the top dead center of the plunger is associated with the value of the crank counter and a second map in which the final counter value is associated with the swing-back amount. The controller may be configured to estimate the swing-back amount based on the final counter value with reference to the second map, and correct the swing-back amount estimated by correcting the second map.

A magnitude of the final counter value which is the value of the crank counter calculated last before the crankshaft stops indicates the compression state of the air contained in the cylinder, and thus has a high correlation with the swing-back amount. Therefore, when the second map in which the final counter value is associated with the swing-back amount is stored as in the above configuration, the swing-back amount can be estimated based on the final counter value with reference to the second map. Further, with the above configuration, the estimated swing-back amount is corrected by correcting the second map, and the swing-back amount used for calculating the stop-time counter value is corrected.

A second aspect of the disclosure relates to an internal combustion engine including a high pressure fuel pump, an in-cylinder fuel injection valve, and the controller. The high pressure fuel pump is configured such that a volume of a fuel chamber is increased and is decreased and fuel is pressurized by a reciprocating motion of a plunger due to an action of a pump cam that rotates in conjunction with a rotation of a crankshaft. The in-cylinder fuel injection valve is configured to inject the fuel into a cylinder. The controller is configured to calculate a crank counter that is counted up at every fixed crank angle when the crankshaft is rotating in a forward rotation direction. The controller is configured to estimate the swing-back amount indicating the turning amount of the crankshaft in the reverse rotation direction until the crankshaft stops. The controller is configured to calculate a stop-time counter value which is a value of the crank counter at the time when the internal combustion engine is stopped based on a final counter value which is the value of the crank counter calculated last before the crankshaft stops and the estimated swing-back amount. The controller is configured to store a map in which a top dead center of the plunger is associated with the value of the crank counter. The controller is configured to calculate the number of driving times of the high pressure fuel pump with reference to the map based on the calculated stop-time counter value and the value of the crank counter. The controller is configured to calculate the number of driving times of the high pressure fuel pump by increasing the number of driving times by one each time a high pressure system fuel pressure which is a pressure of the fuel supplied to the in-cylinder fuel injection valve increases by a threshold or more. The controller is configured to correct the swing-back amount used for calculating the stop-time counter value based on a difference between the number of driving times calculated based on the calculated stop-time counter value and the value of the crank counter and the number of driving times calculated by increasing the number of driving times by one each time the high pressure system fuel pressure increases by the threshold or more. According to the aspect, the same effect as in the first aspect can be obtained.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
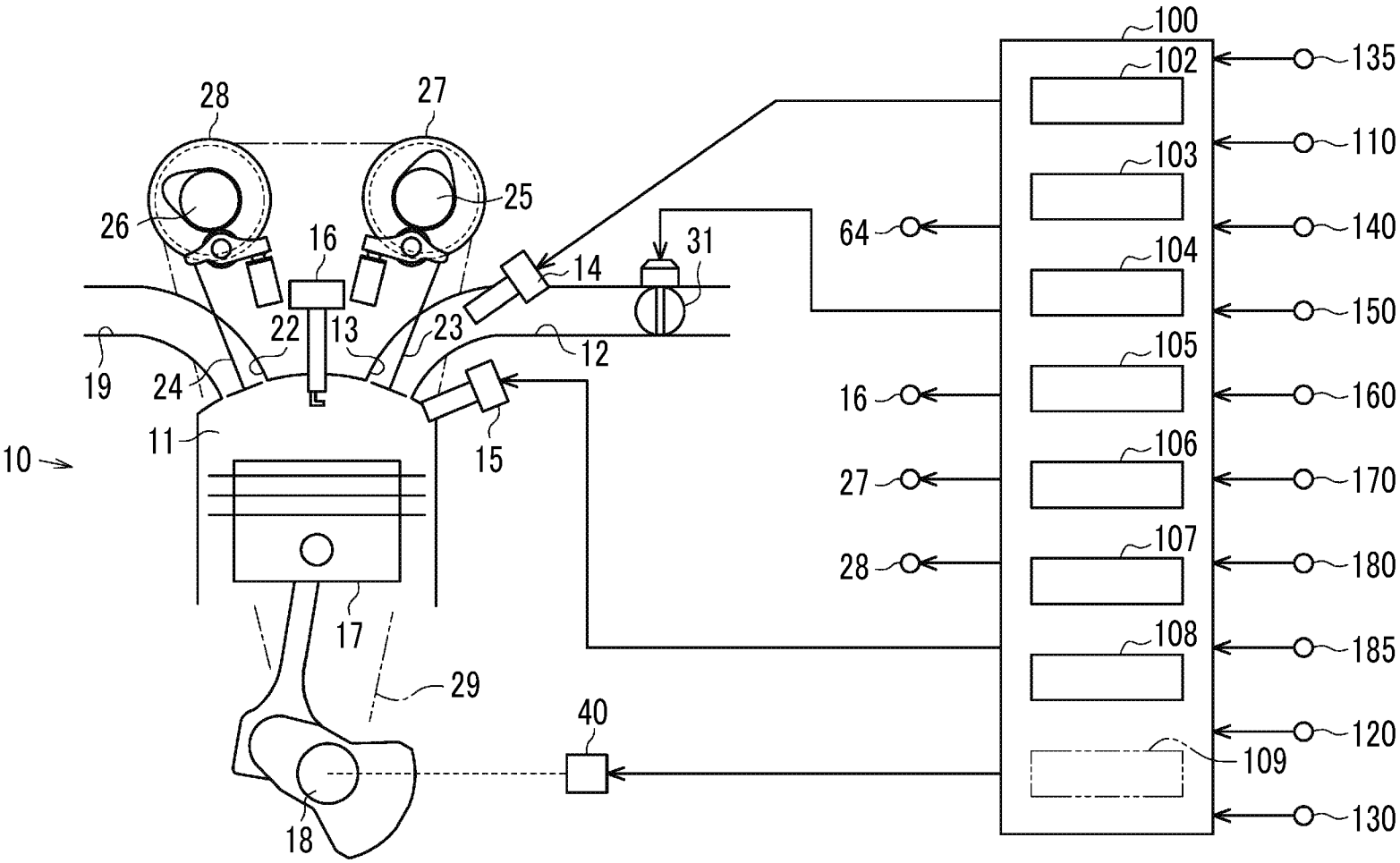
FIG. 1 is a schematic view showing configurations of a controller of an internal combustion engine, and an in-vehicle internal combustion engine that is controlled by the controller.

Hereinafter, an embodiment of a control system for an internal combustion engine will be described with reference to FIG. 1 to FIG. 16. The control system includes a controller 100. As shown in FIG. 1, an intake port 13 of an internal combustion engine 10 controlled by the controller 100 is provided with a port injection valve 14 for injecting fuel during an intake air flowing in the intake port 13. The intake port 13 is connected to an intake passage 12. The intake passage 12 is provided with a throttle valve 31.

Additionally, a combustion chamber 11 is provided with an in-cylinder fuel injection valve 15 for directly injecting the fuel into the combustion chamber 11 and an ignition device 16 for igniting an air-fuel mixture of the air and the fuel introduced into the combustion chamber 11 by a spark discharge. An exhaust passage 19 is connected to the combustion chamber 11 via an exhaust port 22.

The internal combustion engine 10 is an in-vehicle internal combustion engine having in-line four cylinders and includes four combustion chambers 11. However, one of the combustion chambers is solely shown in FIG. 1. When the air-fuel mixture combusts in the combustion chamber 11, a piston 17 reciprocates, and a crankshaft 18 which is an output shaft of the internal combustion engine 10 rotates. Then, an exhaust after combustion is discharged from the combustion chamber 11 to the exhaust passage 19.

The intake port 13 is provided with an intake valve 23. The exhaust port 22 is provided with an exhaust valve 24. The intake valve 23 and the exhaust valve 24 open and close with a rotation of an intake camshaft 25 and an exhaust camshaft 26 to which the rotation of the crankshaft 18 is transmitted.

The intake camshaft 25 is provided with an intake-side variable valve timing mechanism 27 that changes opening/closing timing of the intake valve 23 by changing a relative rotation phase of the intake camshaft 25 with respect to the crankshaft 18. Further, the exhaust camshaft 26 is provided with an exhaust-side variable valve timing mechanism 28 that changes opening/closing timing of the exhaust valve 24 by changing a relative rotation phase of the exhaust camshaft 26 with respect to the crankshaft 18.

A timing chain 29 is wound around the intake-side variable valve timing mechanism 27, the exhaust-side variable valve timing mechanism 28, and the crankshaft 18. As a result, when the crankshaft 18 rotates, the rotation is transmitted via the timing chain 29, and the intake camshaft 25 rotates with the intake-side variable valve timing mechanism 27. In addition, the exhaust camshaft 26 rotates with the exhaust-side variable valve timing mechanism 28.

The internal combustion engine 10 is provided with a starter motor 40, and while the engine is started, the crankshaft 18 is driven by the starter motor 40 to perform a cranking. Next, a fuel supply system of the internal combustion engine 10 will be described with reference to FIG. 2.

Figure 2:
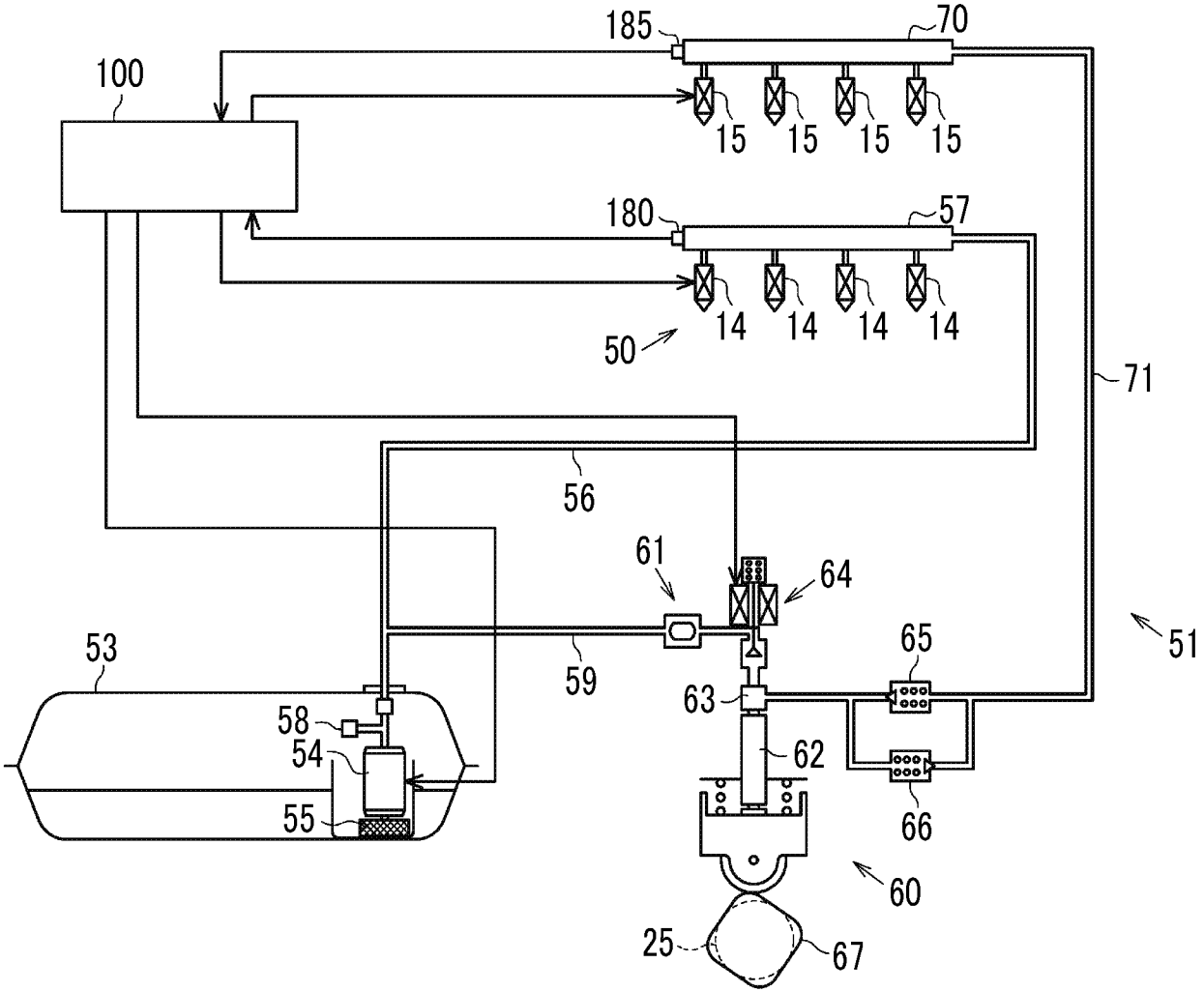
FIG. 2 is a schematic view showing a configuration of a fuel supply system of the internal combustion engine.

As shown in FIG. 2, the internal combustion engine 10 is provided with two system fuel supply systems, a low pressure-side fuel supply system 50 for supplying the fuel to the port injection valve 14 and a high pressure-side fuel supply system 51 for supplying the fuel to the in-cylinder fuel injection valve 15.

A fuel tank 53 is provided with an electric feed pump 54. The electric feed pump 54 pumps up fuel stored in the fuel tank 53 via a filter 55 that filters impurities in the fuel. Then, the electric feed pump 54 supplies the pumped fuel to a low pressure-side delivery pipe 57 to which the port injection valve 14 of each cylinder is connected through a low pressure fuel passage 56. The low pressure-side delivery pipe 57 is provided with a low pressure system fuel pressure sensor 180 that detects the pressure of the fuel stored inside, that is, a low pressure system fuel pressure PL that is the pressure of the fuel supplied to each port injection valve 14.

In addition, the low pressure fuel passage 56 in the fuel tank 53 is provided with a pressure regulator 58. The pressure regulator 58 opens the valve when the pressure of the fuel in the low pressure fuel passage 56 exceeds a specified regulator set pressure to discharge the fuel in the low pressure fuel passage 56 into the fuel tank 53. As a result, the pressure regulator 58 keeps the pressure of the fuel supplied to the port injection valve 14 at the regulator set pressure or less.

On the other hand, the high pressure-side fuel supply system 51 includes a mechanical high pressure fuel pump 60. The low pressure fuel passage 56 branches halfway and is connected to the high pressure fuel pump 60. The high pressure fuel pump 60 is connected via a connection passage 71 to a high pressure-side delivery pipe 70 to which the in-cylinder fuel injection valve 15 of each cylinder is connected. The high pressure fuel pump 60 is driven by the power of the internal combustion engine 10 to pressurize the fuel sucked from the low pressure fuel passage 56 and send the fuel to the high pressure-side delivery pipe 70 by pressure.

The high pressure fuel pump 60 includes a pulsation damper 61, a plunger 62, a fuel chamber 63, a solenoid spill valve 64, a check valve 65, and a relief valve 66. The plunger 62 is reciprocated by a pump cam 67 provided on the intake camshaft 25, and changes the volume of the fuel chamber 63 according to the reciprocating motion. The solenoid spill valve 64 shields the flow of the fuel between the fuel chamber 63 and the low pressure fuel passage 56 by closing the valve in accordance with energization, and allows the flow of the fuel between the fuel chamber 63 and the low pressure fuel passage 56 by opening the valve in accordance with the stop of energization. The check valve 65 allows the fuel to be discharged from the fuel chamber 63 to the high pressure-side delivery pipe 70, and the check valve 65 prohibits the fuel from flowing backward from the high pressure-side delivery pipe 70 to the fuel chamber 63. The relief valve 66 is provided in a passage that bypasses the check valve 65, and is opened to allow the fuel to flow backward to the fuel chamber 63 when the pressure on the high pressure-side delivery pipe 70 becomes excessively high.

When the plunger 62 moves in the direction of expanding the volume of the fuel chamber 63, the high pressure fuel pump 60 opens the solenoid spill valve 64 such that the fuel in the low pressure fuel passage 56 is sucked to the fuel chamber 63. When the plunger 62 moves in the direction of reducing the volume of the fuel chamber 63, the high pressure fuel pump 60 closes the solenoid spill valve 64 such that the fuel sucked to the fuel chamber 63 is pressurized and discharged to the high pressure-side delivery pipe 70. Hereinafter, the movement of the plunger 62 in the direction of expanding the volume of the fuel chamber 63 is referred to as a drop of the plunger 62, and the movement of the plunger 62 in the direction of reducing the volume of the fuel chamber 63 is referred to as a rise of the plunger 62. In the internal combustion engine 10, the amount of the fuel discharged from the high pressure fuel pump 60 is adjusted by changing a ratio of the period in which the solenoid spill valve 64 is closed during the period in which the plunger 62 rises.

Among the low pressure fuel passages 56, a branch passage 59 that is branched and connected to the high pressure fuel pump 60 is connected to a pulsation damper 61 that reduces pressure pulsation of the fuel with the operation of the high pressure fuel pump 60. The pulsation damper 61 is connected to the fuel chamber 63 via the solenoid spill valve 64.

The high pressure-side delivery pipe 70 is provided with a high pressure system fuel pressure sensor 185 that detects the pressure of the fuel in the high pressure-side delivery pipe 70, that is, the high pressure system fuel pressure PH that is the pressure of the fuel supplied to the in-cylinder fuel injection valve 15.

The controller 100 controls the internal combustion engine 10 as a control target by operating various operation target devices such as the throttle valve 31, the port injection valve 14, the in-cylinder fuel injection valve 15, the ignition device 16, the intake-side variable valve timing mechanism 27, the exhaust-side variable valve timing mechanism 28, the solenoid spill valve 64 of the high pressure fuel pump 60, and the starter motor 40.

As shown in FIG. 1, a detection signal of a driver's accelerator operation amount by an accelerator position sensor 110 and a detection signal of a vehicle speed which is a traveling speed of the vehicle by a vehicle speed sensor 140 are input into the controller 100.

Further, detection signals of various other sensors are input into the controller 100. For example, an air flow meter 120 detects a temperature of air sucked to the combustion chamber 11 through the intake passage 12 and an intake air amount which is the mass of the air sucked. A coolant temperature sensor 130 detects a coolant temperature THW, which is a temperature of a coolant of the internal combustion engine 10. A fuel temperature sensor 135 detects a fuel temperature TF that is a temperature of the fuel in the high pressure-side delivery pipe 70.

A crank position sensor 150 outputs the crank angle signal according to a change in a rotation phase of the crankshaft 18. Further, an intake-side cam position sensor 160 outputs an intake-side cam angle signal according to a change in the rotation phase of the intake camshaft 25 of the internal combustion engine 10. The exhaust-side cam position sensor 170 outputs an exhaust-side cam angle signal according to a change in the rotation phase of the exhaust camshaft 26 of the internal combustion engine 10.

Further, as shown in FIG. 1, the controller 100 includes a storage unit 102 for storing a calculation program, a calculation map, and various data. The controller 100 takes in output signals of the various sensors, performs various calculations based on the output signals, and executes various controls related to engine operation according to the calculation results.

The controller 100 includes a crank counter calculation unit 103 that calculates the crank counter indicating the crank angle which is the rotation phase of the crankshaft 18 based on the crank angle signal, the intake-side cam angle signal, and the exhaust-side cam angle signal. The controller 100 controls the fuel injection and ignition timing for each cylinder with reference to the crank counter calculated by the crank counter calculation unit 103, and controls the intake-side variable valve timing mechanism 27 and the exhaust-side variable valve timing mechanism 28.

Specifically, the controller 100 calculates a target fuel injection amount which is a control target value for fuel injection amount based on an accelerator operation amount, a vehicle speed, an intake air amount, an engine rotation speed, an engine load factor, and the like. The engine load factor is a ratio of inflow air amount per combustion cycle of one cylinder to reference inflow air amount. Here, the reference inflow air amount is an inflow air amount per combustion cycle of one cylinder when the opening degree of the throttle valve 31 is maximized, and is determined according to the engine rotation speed. The controller 100 basically calculates the target fuel injection amount such that an air-fuel ratio becomes a stoichiometric air-fuel ratio. Then, control target values for injection timing and fuel injection time in the port injection valve 14 and the in-cylinder fuel injection valve 15 are calculated. The port injection valve 14 and the in-cylinder fuel injection valve 15 are driven to open the valve according to the control target values. As a result, an amount of fuel corresponding to an operation state of the internal combustion engine 10 is injected and supplied to the combustion chamber 11. In the internal combustion engine 10, which injection valve injects the fuel is switched according to the operation state. Therefore, in the internal combustion engine 10, other than when the fuel is injected from both the port injection valve 14 and the in-cylinder fuel injection valve 15, there are cases when the fuel is injected solely from the port injection valve 14 and when the fuel is injected solely from the in-cylinder fuel injection valve 15. Further, the controller 100 stops the injection of the fuel and stops the supply of the fuel to the combustion chamber 11 during a deceleration, for example, when the accelerator operation amount is "0", to perform a fuel cut-off control to reduce a fuel consumption.

Further, the controller 100 calculates an ignition timing which is a timing of a spark discharge by the ignition device 16 to operate the ignition device 16 and ignite the air-fuel mixture. Further, the controller 100 calculates a target value of a phase of the intake camshaft 25 with respect to the crankshaft 18 and a target value of a phase of the exhaust camshaft 26 with respect to the crankshaft 18 based on the engine rotation speed and the engine load factor to operate the intake-side variable valve timing mechanism 27 and the exhaust-side variable valve timing mechanism 28. Thus, the controller 100 controls the opening/closing timing of the intake valve 23 and the opening/closing timing of the exhaust valve 24. For example, the controller 100 controls a valve overlap that is a period where both the exhaust valve 24 and the intake valve 23 are open.

In addition, the controller 100 automatically stops the engine operation by stopping the fuel supply and ignition while the vehicle is stopped, and restarts the engine operation by automatically restarting the fuel supply and ignition at the time at which the vehicle is started. That is, the controller 100 executes a stop & start control for suppressing an idling operation from continuing by automatically stopping and restarting the engine operation.

Further, in the controller 100, when the operation is stopped by the stop & start control, the value of the crank counter while the crankshaft 18 is stopped is stored in the storage unit 102 as a stop-time counter value VCAst.

Next, the crank position sensor 150, the intake-side cam position sensor 160, and the exhaust-side cam position sensor 170 will be described in detail, and a method of calculating the crank counter will be described.

Figure 3:
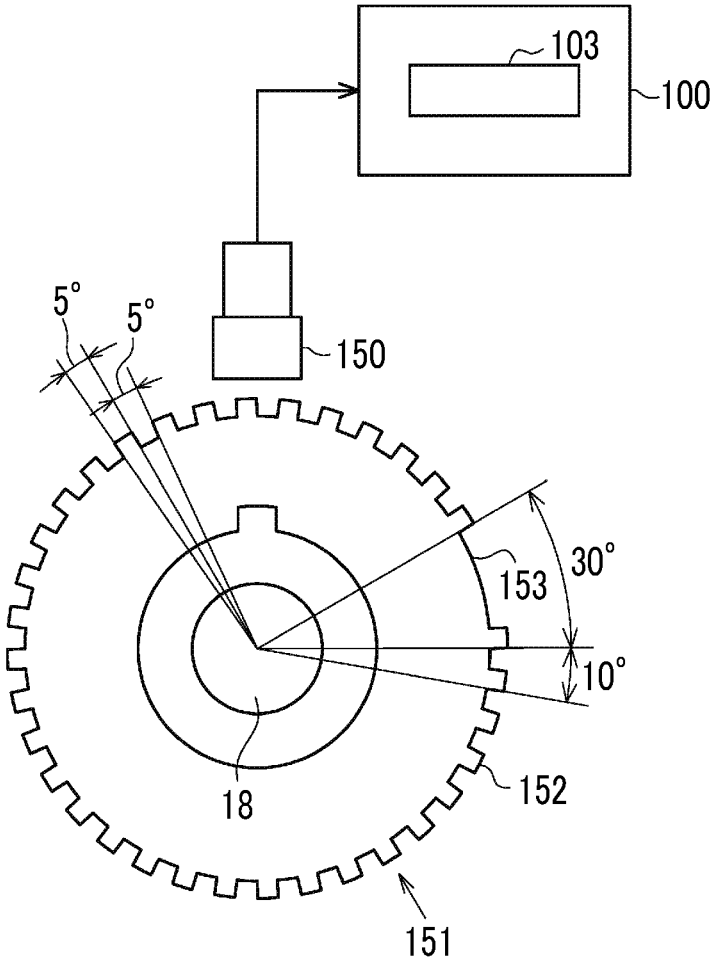
FIG. 3 is a schematic view showing a relationship between a crank position sensor and a sensor plate.

First, the crank position sensor 150 will be described with reference to FIG. 3 and FIG. 4. FIG. 3 shows a relationship between the crank position sensor 150 and the sensor plate 151 attached to the crankshaft 18. A timing chart of FIG. 4 shows the waveform of the crank angle signal output by the crank position sensor 150.

As shown in FIG. 3, the disc-shaped sensor plate 151 is attached to the crankshaft 18. 34 signal teeth 152 having a width of 5° at the angle are arranged side by side at intervals of 5° at a periphery of the sensor plate 151. Therefore, as shown on the right side of FIG. 3, the sensor plate 151 has one missing teeth portion 153 in which the interval between adjacent signal teeth 152 is at the angle of 25° and thus two signal teeth 152 are missing as compared with other portions.

As shown in FIG. 3, the crank position sensor 150 is arranged toward the periphery of the sensor plate 151 so as to face the signal teeth 152 of the sensor plate 151. The crank position sensor 150 is a magnetoresistive element type sensor including a sensor circuit with built-in a magnet and a magnetoresistive element. When the sensor plate 151 rotates with the rotation of the crankshaft 18, the signal teeth 152 of the sensor plate 151 and the crank position sensor 150 come closer or away from each other. As a result, a direction of a magnetic field applied to the magnetoresistive element in the crank position sensor 150 changes, and an internal resistance of the magnetoresistive element changes. The sensor circuit compares the magnitude relationship between a waveform obtained by converting the change in the resistance value into a voltage and a threshold, and shapes the waveform into a rectangular wave based on a Lo signal as the first signal and a Hi signal as the second signal, and outputs the rectangular wave as a crank angle signal.

Figure 4:
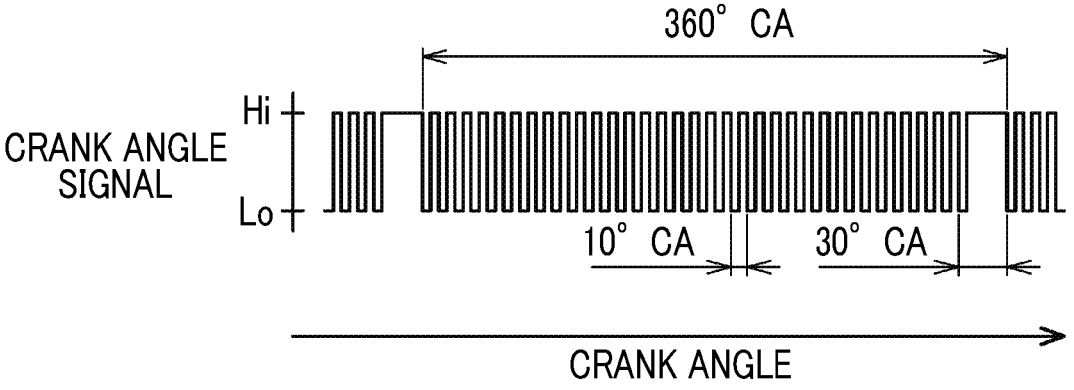
FIG. 4 is a timing chart showing a waveform of a crank angle signal output from the crank position sensor.

As shown in FIG. 4, specifically, the crank position sensor 150 outputs the Lo signal when the crank position sensor 150 faces the signal teeth 152, and outputs the Hi signal when the crank position sensor 150 faces a gap portion between the signal teeth 152. Therefore, when the Hi signal corresponding to the missing teeth portion 153 is detected, the Lo signal corresponding to the signal teeth 152 is subsequently detected. Then, the Lo signal corresponding to the signal teeth 152 is detected every 10° CA. After 34 Lo signals are detected in this way, the Hi signal corresponding to the missing teeth portion 153 is detected again. Therefore, a rotation angle until the Lo signal corresponding to the next signal teeth 152 is detected across the Hi signal corresponding to the missing teeth portion 153 is 30° CA at the crank angle.

As shown in FIG. 4, after the Lo signal corresponding to the signal teeth 152 is detected following the Hi signal corresponding to the missing teeth portion 153, next, an interval until the Lo signal is detected following the Hi signal corresponding to the missing teeth portion 153 is 360° CA at the crank angle.

The crank counter calculation unit 103 calculates the crank counter by counting edges that change from the Hi signal to the Lo signal. Further, based on the detection of the Hi signal corresponding to the missing teeth portion 153 longer than the other Hi signals, it is detected that the rotation phase of the crankshaft 18 is the rotation phase corresponding to the missing teeth portion 153.

Next, the intake-side cam position sensor 160 will be described with reference to FIG. 5. Both the intake-side cam position sensor 160 and the exhaust-side cam position sensor 170 are the magnetoresistive element type sensor similar to the crank position sensor 150. Since the intake-side cam position sensor 160 and the exhaust-side cam position sensor 170 differ solely in the object to be detected, the intake-side cam angle signal detected by the intake-side cam position sensor 160 will be described in detail here.

Figure 5:
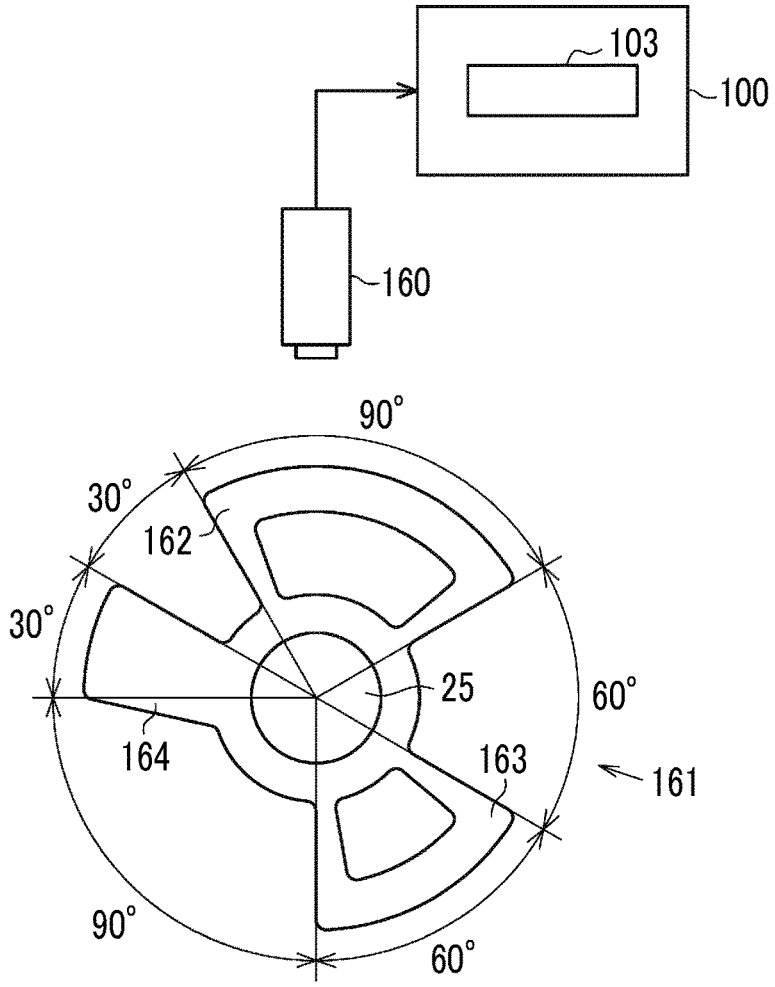
FIG. 5 is a schematic view showing a relationship between an intake-side cam position sensor and a timing rotor.
Figure 6:
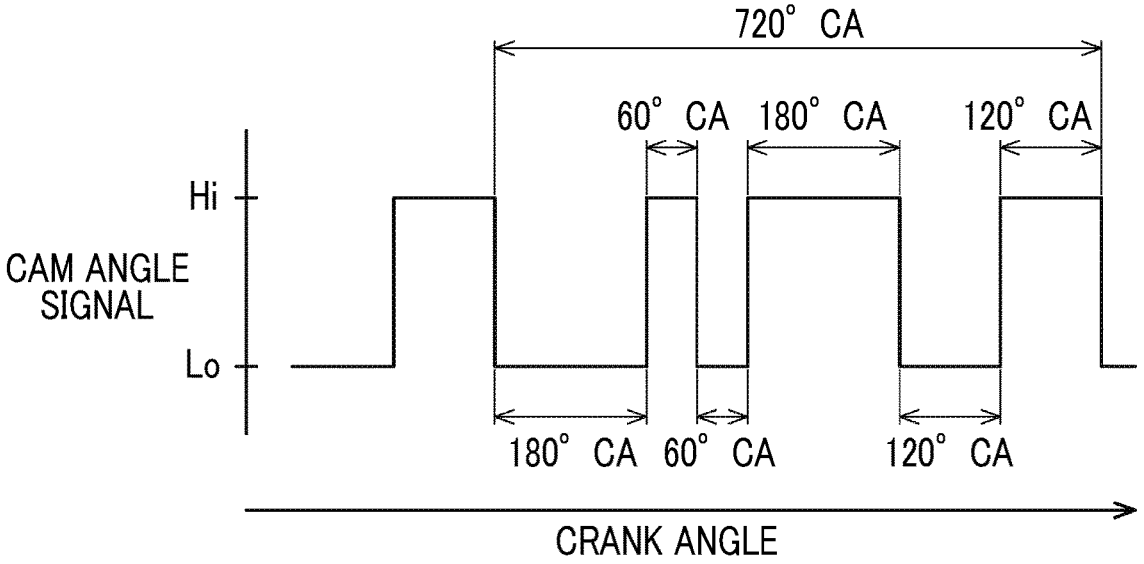
FIG. 6 is a timing chart showing a waveform of an intake-side cam angle signal output from the intake-side cam position sensor.

FIG. 5 shows a relationship between the intake-side cam position sensor 160 and a timing rotor 161 attached to the intake camshaft 25. A timing chart of FIG. 6 shows the waveform of the intake-side cam angle signal output from the intake side cam position sensor 160.

As shown in FIG. 5, the timing rotor 161 is provided with three protrusions, that is, a large protrusion 162, a middle protrusion 163, and a small protrusion 164, each of which has a different occupation range in the circumferential direction.

The largest large protrusion 162 is formed so as to spread over at the angle of 90° in the circumferential direction of the timing rotor 161. On the other hand, the smallest small protrusion 164 is formed so as to spread over at the angle of 30°, and the middle protrusion 163 smaller than the large protrusion 162 and larger than the small protrusion 164 is formed so as to spread over at the angle of 60°.

As shown in FIG. 5, large protrusion 162, middle protrusion 163, and small protrusion 164 are arranged in the timing rotor 161 at predetermined intervals. Specifically, the large protrusion 162 and the middle protrusion 163 are arranged at intervals of 60° at the angle, and the middle protrusion 163 and the small protrusion 164 are arranged at intervals of 90° at the angle. The large protrusion 162 and the small protrusion 164 are arranged at intervals of 30° at the angle.

As shown in FIG. 5, the intake-side cam position sensor 160 is arranged toward the periphery of the timing rotor 161 so as to face the large protrusion 162, the middle protrusion 163, and the small protrusion 164 of the timing rotor 161. The intake-side cam position sensor 160 outputs the Lo signal and the Hi signal as with the crank position sensor 150.

Specifically, as shown in FIG. 6, the intake-side cam position sensor 160 outputs the Lo signal when the intake-side cam position sensor 160 faces the large protrusion 162, the middle protrusion 163, and the small protrusion 164, and outputs the Hi signal when the intake-side cam position sensor 160 faces a gap portion between each protrusion. The intake camshaft 25 rotates once while the crankshaft 18 rotates twice. Therefore, the change of the intake-side cam angle signal repeats a fixed change at a cycle of 720° CA at the crank angle.

As shown in FIG. 6, after the Lo signal that continues over 180° CA corresponding to the large protrusion 162 is output, the Hi signal that continues over 60° CA is output, and then the Lo signal that continues over 60° CA corresponding to the small protrusion 164 is output. After that, the Hi signal that continues over 180° CA is output, and subsequently, the Lo signal that continues over 120° CA corresponding to the middle protrusion 163 is output. In addition, after the Hi signal that continues over 120° CA is output lastly, the Lo signal that continues over 180° CA corresponding to the large protrusion 162 is output again.

Therefore, since the intake-side cam angle signal periodically changes in a fixed change pattern, the controller 100 can detect what rotation phase the intake camshaft 25 is in by recognizing the change pattern of the cam angle signal. For example, when the Lo signal is switched to the Hi signal after the Lo signal having the length corresponding to 60° CA is output, the controller 100 can detect that the small protrusion 164 is the rotation phase immediately after passing in front of the intake-side cam position sensor 160 based on the switch.

In the internal combustion engine 10, the timing rotor 161 having the same shape is also attached to the exhaust camshaft 26. Therefore, the exhaust-side cam angle signal detected by the exhaust-side cam position sensor 170 also changes periodically in the same change pattern as the intake-side cam angle signal shown in FIG. 6. Therefore, the controller 100 can detect what rotation phase the exhaust camshaft 26 is in by recognizing the change pattern of the exhaust-side cam angle signal output from the exhaust-side cam position sensor 170.

The timing rotor 161 attached on the exhaust camshaft 26 is attached by deviating a phase with respect to the timing rotor 161 attached on the intake camshaft 25. Specifically, the timing rotor 161 attached on the exhaust camshaft 26 is attached by deviating a phase by 30° to an advance angle side with respect to the timing rotor 161 attached on the intake camshaft 25.

Figure 7:
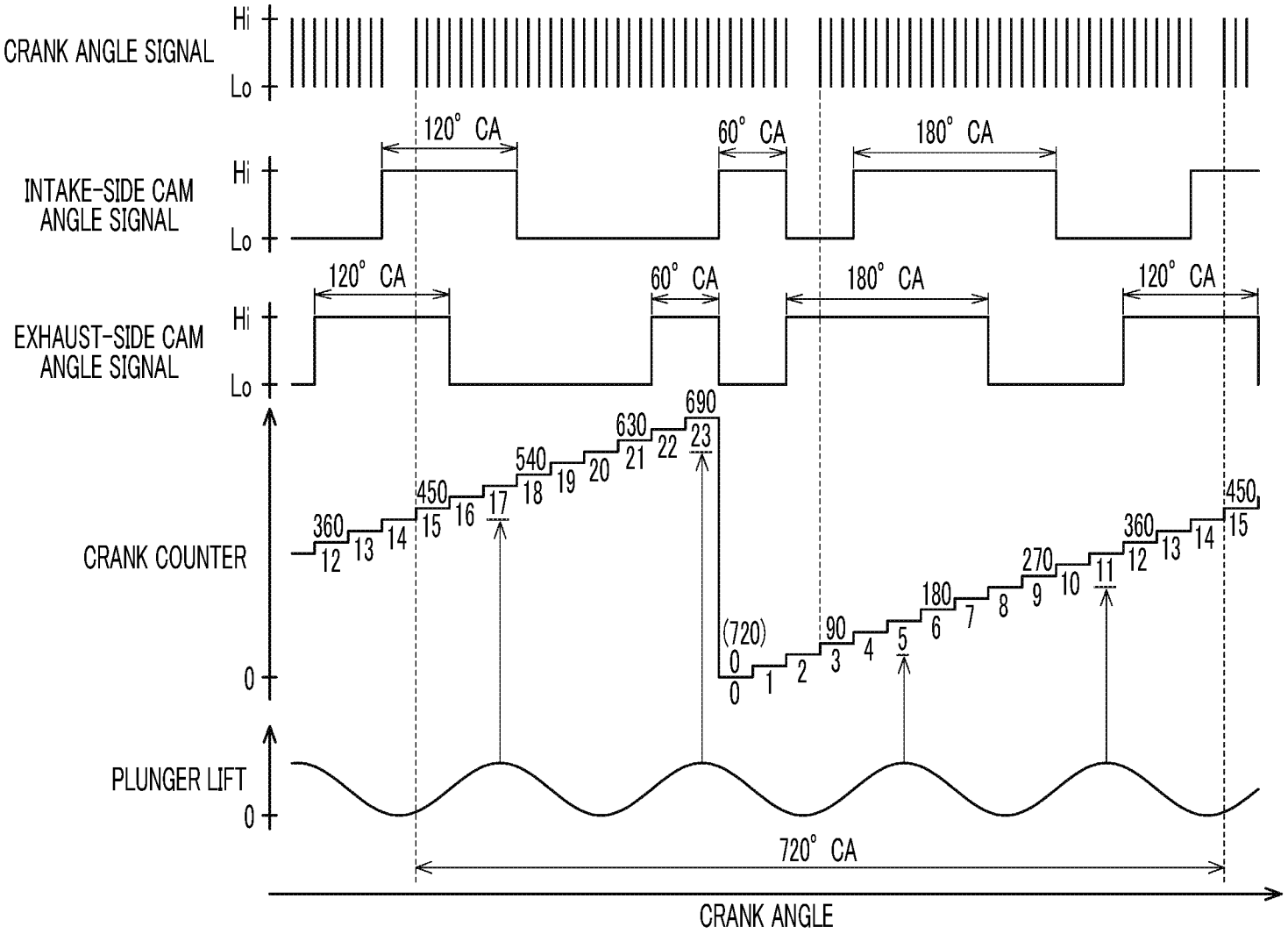
FIG. 7 is a timing chart showing a relationship between the crank angle signal, the cam angle signal, and a crank counter, and a relationship between the crank counter and a top dead center of a plunger.

As a result, as shown in FIG. 7, the change pattern of the intake-side cam angle signal changes with a delay of 60° CA at the crank angle with respect to the change pattern of the exhaust-side cam angle signal.

FIG. 7 is a timing chart showing a relationship between the crank angle signal and the crank counter, and a relationship between the crank counter and the cam angle signal. In addition, the edges that change from the Hi signal to the Lo signal in the crank angle signal is solely shown in FIG. 7.

As described above, the crank counter calculation unit 103 of the controller 100 counts the edges when the crank angle signal output from the crank position sensor 150 changes from the Hi signal to the Lo signal with the engine operation, and calculates the crank counter. Further, the crank counter calculation unit 103 performs cylinder discrimination based on the crank angle signal, the intake-side cam angle signal, and the exhaust-side cam angle signal.

Specifically, as shown in FIG. 7, the crank counter calculation unit 103 counts the edges of the crank angle signal output every 10° CA, and counts up the crank counter each time three edges are counted. That is, the crank counter calculation unit 103 counts up a value of the crank counter VCA which is the value of the crank counter every 30° CA. The controller 100 recognizes the current crank angle based on the value of the crank counter VCA, and controls the timing of fuel injection and ignition for each cylinder.

Further, the crank counter is reset periodically every 720° CA. That is, as shown in the center of FIG. 7, at the next count-up timing after counting up to "23" corresponding to 690° CA, the value of the crank counter VCA is reset to "0", and the crank counter is again counted up every 30° CA.

When the missing teeth portion 153 passes in front of the crank position sensor 150, the detected edge interval is 30° CA. Therefore, when the interval between the edges is widened, the crank counter calculation unit 103 detects that the missing teeth portion 153 has passed in front of the crank position sensor 150 based on the interval. Since missing teeth detection is performed every 360° CA, the missing teeth detection is performed twice during 720° CA while the crank counter is counted up for one cycle.

Since the crankshaft 18, the intake camshaft 25, and the exhaust camshaft 26 are connected to each other via the timing chain 29, a change in the crank counter and a change in the cam angle signal have a fixed correlation.

That is, the intake camshaft 25 and the exhaust camshaft 26 rotate once while the crankshaft 18 rotates twice. Therefore, in a case where the value of the crank counter VCA is known, the rotation phases of the intake camshaft 25 and the exhaust camshaft 26 at that time can be estimated. In a case where the rotation phases of the intake camshaft 25 and the exhaust camshaft 26 are known, the value of the crank counter VCA can be estimated.

The crank counter calculation unit 103 decides the crank angle that becomes a starting point when the crank counter calculation unit 103 starts the calculation of the crank counter and also decides the value of the crank counter VCA using a relationship between the intake-side cam angle signal, the exhaust-side cam angle signal, and the value of the crank counter VCA, and a relationship between the missing teeth detection and the value of the crank counter VCA.

In addition, after the crank angle is identified and the value of the crank counter VCA to be a starting point is identified, the crank counter calculation unit 103 starts counting up from the identified value of the crank counter VCA as a starting point. That is, the crank counter is not decided and is not output while the crank angle is not identified and the value of the crank counter VCA as a starting point is not identified. After the value of the crank counter VCA to be a starting point is identified, the count-up is started from the identified value of the crank counter VCA as a starting point, and the value of the crank counter VCA is output.

When a relative phase of the intake camshaft 25 with respect to the crankshaft 18 is changed by the intake-side variable valve timing mechanism 27, relative phases of the sensor plate 151 attached to the crankshaft 18 and the timing rotor 161 attached to the intake camshaft 25 are changed. Therefore, the controller 100 grasps the change amount in the relative phase according to a displacement angle which is the operation amount of the intake-side variable valve timing mechanism 27, and decides the value of the crank counter VCA to be a starting point considering an influence according to the change in the relative phase. The same applies to the change of the relative phase of the exhaust camshaft 26 by the exhaust-side variable valve timing mechanism 28.

In the internal combustion engine 10, as shown in FIG. 7, the crank angle when the intake cam angle signal switches from the Lo signal that continues over 180° CA to the Hi signal that continues over 60° CA is set to "0° CA". Therefore, as shown by a broken line in FIG. 7, the missing teeth detection performed immediately after the intake cam angle signal is switched from the Hi signal to the Lo signal that continues over 60° CA indicates that the crank angle is 90° CA. On the other hand, the missing teeth detection performed immediately after the intake cam angle signal is switched from the Lo signal to the Hi signal that continues over 120° CA indicates that the crank angle is 450° CA. In addition, in FIG. 7, the value of the crank counter VCA is shown below a solid line indicating a change of the value of the crank counter, and the crank angle corresponding to the value of the crank counter VCA is shown above this solid line. FIG. 7 shows a state where the displacement angle in the intake-side variable valve timing mechanism 27 and the displacement angle in the exhaust-side variable valve timing mechanism 28 are both "0".

As described above, since the change in the cam angle signal and the crank angle have a correlation with each other, in some cases, the value of the crank counter VCA as a starting point can be quickly decided without waiting for the missing teeth detection by estimating the crank angle corresponding to the combination of the intake-side cam angle signal and the exhaust-side cam angle signal according to the pattern of the combination.

However, in the case of automatic restart from automatic stop by stop & start control, it is preferable to execute the in-cylinder fuel injection that can inject the fuel directly into the cylinder to quickly restart combustion. When the fuel is supplied into the cylinder by port injection, it takes more time for the fuel to reach the cylinder than when the fuel injection is executed by the in-cylinder fuel injection valve 15 or the fuel adheres to the intake port 13. Therefore, there is a possibility that startability may be deteriorated.

Accordingly, at the time of automatic restart from automatic stop by the stop & start control, the controller 100 executes the engine start by in-cylinder fuel injection. However, since the high pressure fuel pump 60 is not driven while the engine is stopped, the high pressure system fuel pressure PH at the time of automatic restart may drop to an insufficient level to execute the in-cylinder fuel injection. When the high pressure system fuel pressure PH is low, the engine cannot be properly started by the in-cylinder fuel injection. Therefore, when the high pressure system fuel pressure PH at the time of the automatic restart is low, the high pressure fuel pump 60 is driven by cranking by the starter motor 40, and the in-cylinder fuel injection is performed after waiting for the high pressure system fuel pressure PH to increase.

When an abnormality occurs in the high pressure-side fuel supply system 51 including the high pressure system fuel pressure sensor 185 and the high pressure fuel pump 60, the high pressure system fuel pressure PH detected by the high pressure system fuel pressure sensor 185 may not be sufficiently high even though the high pressure fuel pump 60 is driven.

Therefore, as shown in FIG. 1, the controller 100 is provided with a first number of driving times calculation unit 107 and a second number of driving times calculation unit 108 as the number of driving times calculation unit calculating the number of pump driving times NP, and calculates the number of pump driving times NP, which is the number of driving times of the high pressure fuel pump 60, using the value of the crank counter VCA. Then, the controller 100 determines whether or not the in-cylinder fuel injection can be performed using the number of pump driving times NP.

The first number of driving times calculation unit 107 calculates the number of pump driving times NP using a relationship between the value of the crank counter VCA and the top dead center of the plunger 62 of the high pressure fuel pump 60. Additionally, in the following, the top dead center of the plunger 62 is referred to as a pump TDC. On the other hand, the second number of driving times calculation unit 108 calculates the number of pump driving times NP based on a change in the high pressure system fuel pressure PH.

As shown in FIG. 7, lift amount of the plunger 62 of the high pressure fuel pump 60 fluctuates periodically according to the change of the value of the crank counter VCA. This is because the pump cam 67 that drives the plunger 62 of the high pressure fuel pump 60 is attached to the intake camshaft 25. That is, in the internal combustion engine 10, the pump TDC can be linked to the value of the crank counter VCA, as indicated by the arrow in FIG. 7. In FIG. 7, the value of the crank counter VCA corresponding to the pump TDC is underlined.

The storage unit 102 of the controller 100 stores a first map in which the pump TDC is associated with the value of the crank counter VCA. In addition, the first number of driving times calculation unit 107 calculates the number of pump driving times NP with reference to the first map based on the value of the crank counter VCA.

Figure 8:
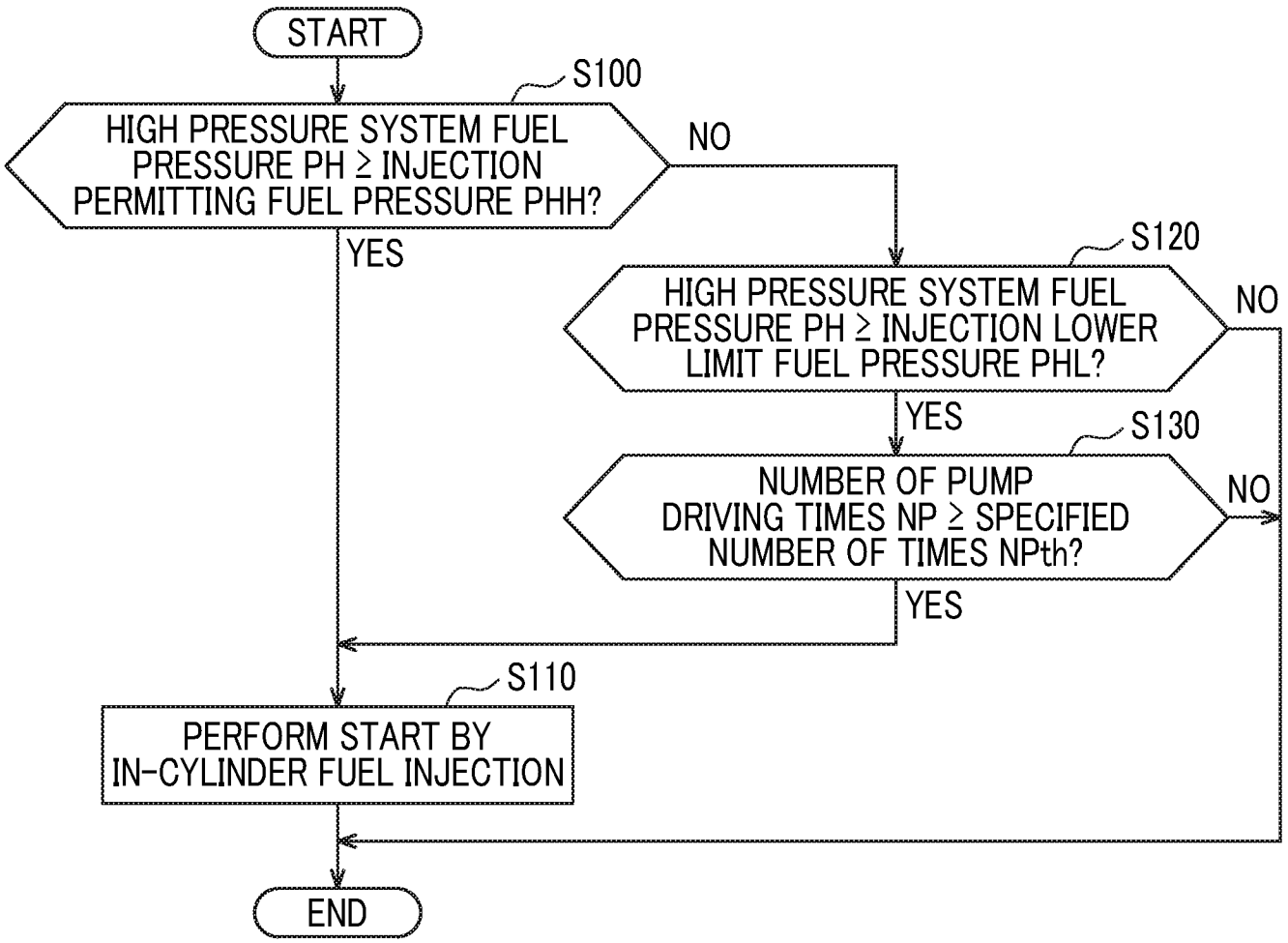
FIG. 8 is a flowchart showing a flow of a series of processing in routine executed when whether or not to start an engine by an in-cylinder fuel injection is determined.

Hereinafter, the control at the time of restarting and the calculation of the number of pump driving times NP executed by the controller 100 will be described. First, with reference to FIG. 8, processing of determining whether or not to perform the start by the in-cylinder fuel injection at the time of restarting will be described. FIG. 8 is a flowchart showing a flow of processing in routine executed by controller 100 at the time of restarting.

When the restart is performed, the controller 100 repeatedly executes the routine under the condition that the coolant temperature THW is equal to or more than a permitting coolant temperature. When the coolant temperature THW is low, it is difficult for the fuel to atomize, and there is a possibility that the engine start by the in-cylinder fuel injection fails. Therefore, even at the time when the controller 100 is restarted, the controller 100 does not execute the routine, but performs the engine start by the port injection in a case where the coolant temperature THW is less than the permitting coolant temperature.

As shown in FIG. 8, when the routine is started, the controller 100 determines whether or not the high pressure system fuel pressure PH is equal to or more than the injection permitting fuel pressure PHH in processing of step S100. The injection permitting fuel pressure PHH is a threshold for determining that the high pressure system fuel pressure PH is high enough to start the internal combustion engine 10 by the in-cylinder fuel injection based on the fact that the high pressure system fuel pressure PH is equal to or more than the injection permitting fuel pressure PHH. Since the start by the in-cylinder fuel injection becomes more difficult as the temperature of the internal combustion engine 10 becomes lower, the injection permitting fuel pressure PHH is set to a value corresponding to the coolant temperature THW so as to become higher value as the coolant temperature THW becomes lower.

When processing of step S100 determines that the high pressure system fuel pressure PH is equal to or more than the injection permitting fuel pressure PHH (step S100: YES), the controller 100 causes the processing to proceed to step S110. Then, the controller 100 is started by the in-cylinder fuel injection in the processing of step S110.

Specifically, the fuel is injected from the in-cylinder fuel injection valve 15, and the ignition is performed by the ignition device 16, and the start by the in-cylinder fuel injection is performed. When the processing of step S110 is performed in this way, the controller 100 temporarily ends the series of processing.

On the other hand, when the processing of step S110 determines that the high pressure system fuel pressure PH is less than the injection permitting fuel pressure PHH (step S100: NO), the controller 100 causes the processing to proceed to step S120. In addition, the controller 100 determines whether or not high pressure system fuel pressure PH is equal to or more than an injection lower limit fuel pressure PHL in the processing of step S120. The injection lower limit fuel pressure PHL is a threshold for determining that the start by the in-cylinder fuel injection is not to be performed based on the fact that the high pressure system fuel pressure PH is less than the injection lower limit fuel pressure PHL. The injection lower limit fuel pressure PHL is less than the injection permitting fuel pressure PHH. Further, as described above, since the start by the in-cylinder fuel injection becomes more difficult as the temperature of the internal combustion engine 10 becomes lower, the injection lower limit fuel pressure PHL is also set to a value corresponding to the coolant temperature THW so as to become higher value as the coolant temperature THW becomes lower as with the injection permitting fuel pressure PHH.

When the processing of step S120 determines that the high pressure system fuel pressure PH is less than the injection lower limit fuel pressure PHL (step S120: NO), the controller 100 temporarily ends the series of processing. That is, in this case, the controller 100 does not execute the processing of step S110, and does not execute the start by the in-cylinder fuel injection.

On the other hand, when the processing of step S120 determines that the high pressure system fuel pressure PH is equal to or more than the injection lower limit fuel pressure PHL (step S120: YES), the controller 100 causes the processing to proceed to step S130. In addition, in the processing of step S130, the controller 100 determines whether or not the number of pump driving times NP calculated by the first number of driving times calculation unit 107 is equal to or more than the specified number of times NPth. In addition, the specified number of times NPth is set based on the number of driving times of the high pressure fuel pump 60 needed to increase the high pressure system fuel pressure PH to a pressure at which the start by the in-cylinder fuel injection can be performed. That is, the specified number of times NPth is a threshold for determining whether or not the number of pump driving times NP has reached the number of driving times needed to increase the high pressure system fuel pressure PH to a pressure at which the start by the in-cylinder fuel injection can be performed.

When the processing of step S130 determines that the number of pump driving times NP is less than the specified number of times NPth (step S130: NO), the controller 100 temporarily ends the series of processing. That is, in this case, the controller 100 does not execute the processing of step S110, and does not execute the start by the in-cylinder fuel injection.

On the other hand, when the processing of step S130 determines that the number of pump driving times NP is equal to or more than the specified number of times NPth (step S130: YES), the controller 100 causes the processing to proceed to step S110 and performs the start by in-cylinder fuel injection. In addition, the controller 100 temporarily ends the series of processing.

The series of processing is repeatedly executed. Therefore, the high pressure system fuel pressure PH becomes equal to or more than the injection permitting fuel pressure PHH, or the number of pump driving times NP becomes equal to or more than the specified number of times NPth by driving the high pressure fuel pump 60 with the cranking performed along with the series of processing. As a result, the in-cylinder fuel injection may be performed while the series of processing is repeated.

However, the controller 100 stops repeating the execution of the routine even when the period during which the series of processing is repeated is equal to or longer than the predetermined period and the engine start by the in-cylinder fuel injection cannot be completed as well as when the engine start by the in-cylinder fuel injection is completed.

In addition, when the engine start by the in-cylinder fuel injection cannot be completed, the engine start by the port injection is performed. That is, when the condition for performing the engine start by the in-cylinder fuel injection is not satisfied even after the predetermined period has elapsed, the controller 100 switches to the engine start by the port injection. Further, the controller 100 switches to the engine start by the port injection in a case where, even though the condition for performing the engine start by the in-cylinder fuel injection is satisfied to execute the processing of step S110 and the engine start by the in-cylinder fuel injection is performed, the engine start has not been completed even after the predetermined period has elapsed.

Therefore, even in a case where the high pressure system fuel pressure PH is less than the injection permitting fuel pressure PHH, the controller 100 performs the start by the in-cylinder fuel injection under the condition that the number of pump driving times NP is equal to or more than the specified number of times NPth when the high pressure system fuel pressure PH is equal to or more than the injection lower limit fuel pressure PHL. As a result, in the internal combustion engine 10, when the high pressure system fuel pressure PH is increased to the injection lower limit fuel pressure PHL or more, and the high pressure fuel pump 60 is driven to such an extent that the high pressure system fuel pressure PH may be high enough to allow the in-cylinder fuel injection, even when the high pressure system fuel pressure PH is not equal to or more than the injection permitting fuel pressure PHH, the start by the in-cylinder fuel injection is performed.

Therefore, even in a case where the high pressure system fuel pressure PH detected by the high pressure system fuel pressure sensor 185 is hardly increased for some reason, the start by the in-cylinder fuel injection is attempted when the start by the in-cylinder fuel injection is likely to succeed. Accordingly, when the high pressure system fuel pressure PH is less than the injection permitting fuel pressure PHH, the possibility that the start can be completed by the in-cylinder fuel injection increases as compared with the case where the start by the in-cylinder fuel injection is not uniformly performed.

Next, a method of calculating the number of pump driving times NP by the first number of driving times calculation unit 107 will be described. The first number of driving times calculation unit 107 repeats the processing of calculating the number of pump driving times NP from the start of the internal combustion engine 10 until completion of the start thereof, and counts the number of pump driving times NP until completion of the start. After the start is completed, the number of pump driving times NP is reset.

Figure 9:
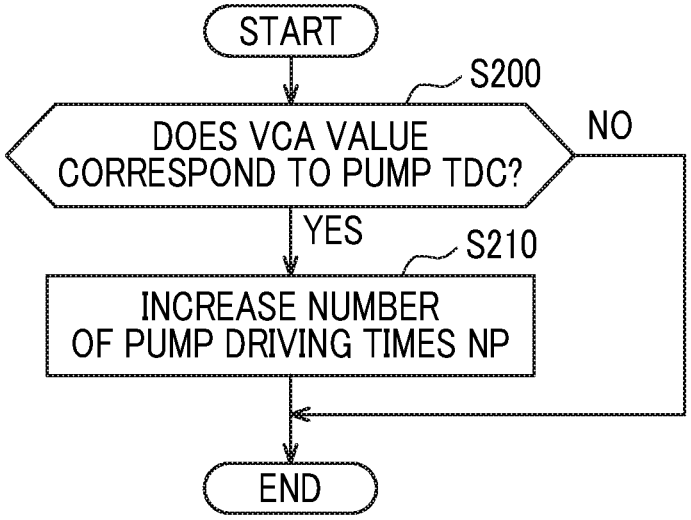
FIG. 9 is a flowchart showing a flow of processing in routine counting the number of pump driving times using the crank counter.

With reference to FIG. 9, a count processing calculating the number of pump driving times NP executed by the first number of driving times calculation unit 107 will be described. When the value of the crank counter VCA has already been identified, the first number of driving times calculation unit 107 repeatedly executes the count processing shown in FIG. 9 each time the value of the crank counter VCA is updated.

As shown in FIG. 9, when the count processing is started, the first number of driving times calculation unit 107 determines whether or not the value of the crank counter VCA is a value corresponding to the pump TDC in the processing of step S200 with reference to the first map stored in the storage unit 102. That is, the first number of driving times calculation unit 107 determines whether or not the value of the crank counter VCA is equal to any of values corresponding to the pump TDC stored in the first map, and when the value of the crank counter VCA and the any of values are equal, the first number of driving times calculation unit 107 determines that the value of the crank counter VCA is the value corresponding to the pump TDC.

When the processing of step S200 determines that the value of the crank counter VCA is the value corresponding to the pump TDC (step S200: YES), the first number of driving times calculation unit 107 causes the processing to proceed to step S210. Then, in the processing of step S210, the first number of driving times calculation unit 107 increases the number of pump driving times NP by one. Then, the first number of driving times calculation unit 107 temporarily ends the routine.

On the other hand, when the processing of step S200 determines that the value of the crank counter VCA is not the value corresponding to the pump TDC (step S200: NO), the first number of driving times calculation unit 107 does not execute the processing of step S210, and temporarily ends the routine as it is. That is, at this time, the number of pump driving times NP is not increased and is maintained as the value is.

In this way, in the count processing, the number of pump driving times NP is calculated by increasing the number of pump driving times NP under the condition that the value of the crank counter VCA is the value corresponding to the pump TDC.

Next, the count processing executed by the first number of driving times calculation unit 107 when the value of the crank counter VCA has not been identified yet will be described. In addition, the fact that the value of the crank counter VCA has not been identified yet means that the engine has just started, and the number of pump driving times NP has not been calculated.

Figure 10:
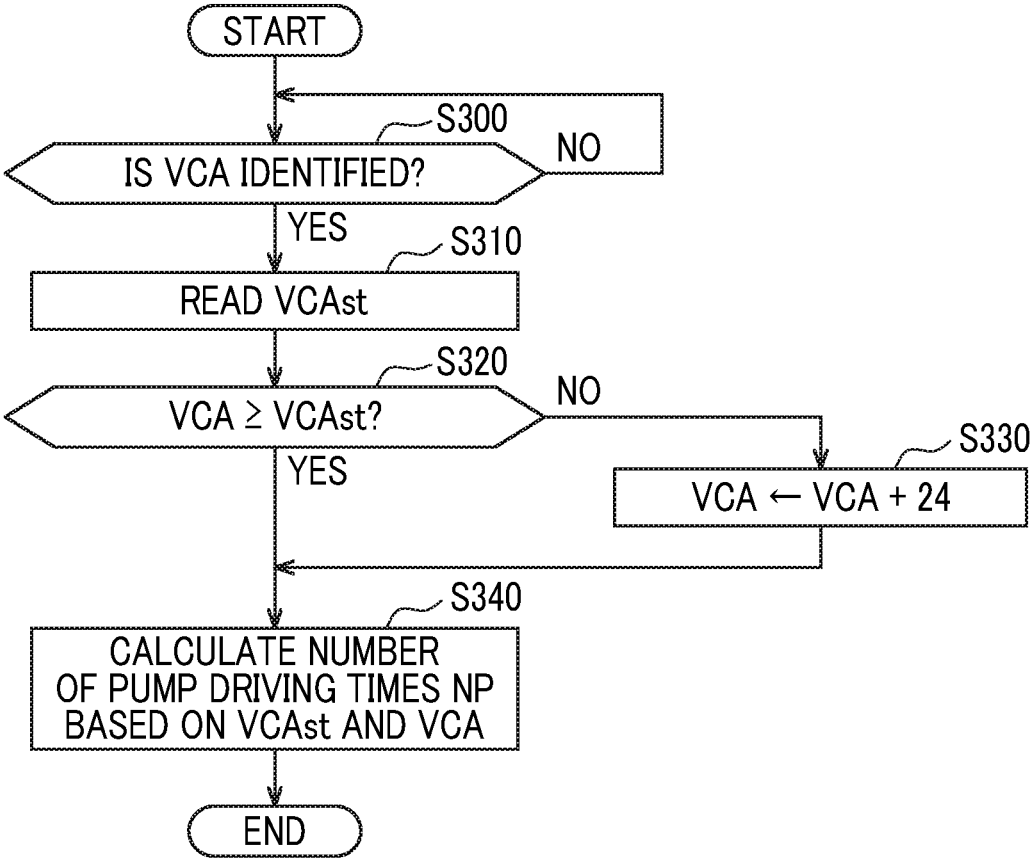
FIG. 10 is a flowchart showing a flow of processing in routine calculating the number of pump driving times until the crank angle is identified.

As shown in FIG. 10, when the count processing is started, the first number of driving times calculation unit 107 determines whether or not the crank angle is identified in the processing of step S300 and the value of the crank counter VCA is identified. When the processing of step S300 determines that the value of the crank counter VCA is not identified (step S300: NO), the first number of driving times calculation unit 107 repeats the processing of step S300. On the other hand, when the processing of step S300 determines that the value of the crank counter VCA is identified (step S300: YES), the first number of driving times calculation unit 107 causes the processing to proceed to step S310. In other words, the first number of driving times calculation unit 107 causes the processing to proceed to step S310 after waiting for the crank angle to be identified and the value of the crank counter VCA to be identified.

In the processing of step S310, the first number of driving times calculation unit 107 reads the stop-time counter value VCAst stored in the storage unit 102. Then, the processing proceeds to step S320. In the processing of step S320, the first number of driving times calculation unit 107 determines whether or not the identified value of the crank counter VCA is equal to or more than the stop-time counter value VCAst.

When the processing of step S320 determines that the identified value of the crank counter VCA is equal to or more than the stop-time counter value VCAst (step S320: YES), the first number of driving times calculation unit 107 causes the processing to proceed to step S340.

On the other hand, when the processing of step S320 determines that the identified value of the crank counter VCA is less than the stop-time counter value VCAst (step S320: NO), the first number of driving times calculation unit 107 causes the processing to proceed to step S330. The first number of driving times calculation unit 107 adds "24" to the identified value of the crank counter VCA in the processing of step S330, and the sum is newly set as the value of the crank counter VCA. That is, "24" is added to the value of the crank counter VCA to update the value of the crank counter VCA. Then, the first number of driving times calculation unit 107 causes the processing to proceed to step S340.

In the processing of step S340, with reference to the first map stored in the storage unit 102, the first number of driving times calculation unit 107 calculates the number of pump driving times NP based on the stop-time counter value VCAst and the value of the crank counter VCA stored in the storage unit 102.

Figure 11:
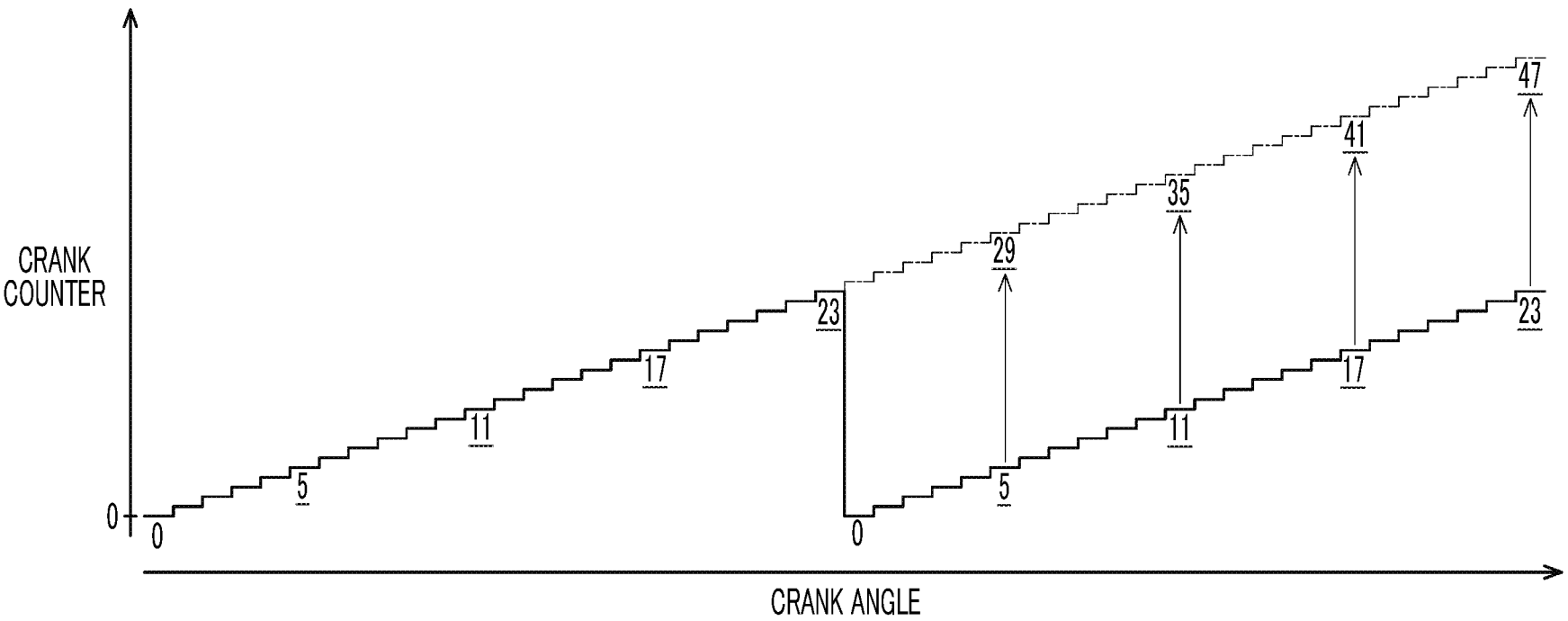
FIG. 11 is an explanatory diagram showing a relationship between information in a first map stored in a storage unit and the crank counter.

The first map stored in the storage unit 102 stores the value of the crank counter VCA which is underlined in FIG. 11. The underlined value of the crank counter VCA is the value of the crank counter VCA corresponding to the pump TDC as described above.

In the first map, the value of the crank counters VCA "5", "11", "17", and "23" corresponding to the pump TDC in the range of 0° CA to 720° CA store "29", "35", "41", and "47" obtained by adding "24" corresponding to the number of the value of the crank counter in the range of 0° CA to 720° CA. That is, the value of the crank counter corresponding to the pump TDC among the value of the crank counters corresponding to the four rotations of the crankshaft 18 without being reset halfway is stored in the first map.

In the processing of step S340, with reference to the first map stored in the storage unit 102, the first number of driving times calculation unit 107 searches the number of value of the crank counters corresponding to the pump TDC between the value of the crank counter VCA and the stop-time counter value VCAst based on the stop-time counter value VCAst and the value of the crank counter VCA. Then, the number calculated in this way is set as the number of pump driving times NP.

That is, in the count processing, the number of pump driving times NP from the start of the engine to the identification of the value of the crank counter VCA is calculated by counting the number of value of the crank counters corresponding to the pump TDC existing between the stop-time counter value VCAst stored in the storage unit 102 and the identified value of the crank counter VCAst.

When the identified value of the crank counter VCA is less than the stop-time counter value VCAst (step S320: NO), "24" is added to update the value of the crank counter VCA (step S330). That is, as shown in FIG. 11, because the value of the crank counter is reset at 720° CA.

Since the value of the crank counter is reset halfway, for example, the crank angle is identified and the identified value of the crank counter VCA is "8", whereas the identified value of the crank counter VCA may be less than the stop-time counter value VCAst, such as the stop-time counter value VCAst stored in the storage unit 102 being "20".

In such a case, the processing of step S320 determines that the identified value of the crank counter VCA found is less than the stop-time counter value VCAst (step S320: NO). Then, in the processing of step S330, "24" is added to the value of the crank counter VCA, and the value of the crank counter VCA is updated to "32". The first map stores "23" and "29" existing between "20" which is the stop-time counter value VCAst and "32" which is the updated value of the crank counter VCA. Therefore, in this case, through the processing of step S340, by searching with reference to the first map, it is calculated that there are two value of the crank counters corresponding to the pump TDC between the stop-time counter value VCAst and the identified value of the crank counter VCA. As a result, the number of pump driving times NP becomes "2".

Accordingly, the crank angle changes across the phase in which the value of the crank counter VCA is reset to "0" until the crank angle is identified, and the number of pump driving times NP can be calculated even when the identified value of the crank counter VCA is less than the stop-time counter value VCAst.

Since the pump cam 67 for driving the high pressure fuel pump 60 is attached to the intake camshaft 25, when the relative phase of the intake camshaft 25 with respect to the crankshaft 18 is changed by the intake-side variable valve timing mechanism 27, a corresponding relationship between the value of the crank counter VCA and the pump TDC changes. Therefore, the first number of driving times calculation unit 107 grasps the change amount in the relative phase according to a displacement angle which is the operation amount of the intake-side variable valve timing mechanism 27 and calculates the number of pump driving times NP in step S340 considering an influence according to the change in the relative phase. That is, the number of pump driving times NP in S340 is calculated by correcting the value of the crank counter VCA corresponding to the pump TDC stored in the first map so as to correspond to the change in the relative phase.

For example, when the relative phase of the intake camshaft 25 is changed to the advance angle side, the correction is performed such that the value of the crank counter VCA stored in the first map is reduced by an amount corresponding to the advance angle amount, and then the number of pump driving times NP is calculated.

When the number of pump driving times NP is calculated in this way, the first number of driving times calculation unit 107 ends this series of processing. Further, when the execution of the count processing is completed, the value of the crank counter VCA is already identified. Therefore, when the count processing is executed after the count processing is ended, the count processing described with reference to FIG. 9 determining whether or not to count up the number of pump driving times NP with reference to the first map each time the value of the crank counter VCA is updated is executed.

Incidentally, as described above, the stop-time counter value VCAst is needed to calculate the number of pump driving times NP until the crank angle is identified using the value of the crank counter VCA. Although the crank position sensor 150 cannot determine the reverse rotation of the crankshaft 18, when the crankshaft 18 stops, the crankshaft 18 may swing in the reverse rotation direction due to the reaction force of the air compressed in the cylinder to recover. Therefore, the influence of such a swing-back needs to be reflected in the value of the crank counter VCA calculated by the crank counter calculation unit 103 to obtain the stop-time counter value VCAst.

Therefore, as shown in FIG. 1, the controller 100 is provided with an estimation unit 105 estimating a swing-back amount $\alpha$ indicating the turning amount of the crankshaft 18 in the reverse rotation direction until the crankshaft 18 stops to calculate the stop-time counter value VCAst in consideration of such swing-back. Further, the controller 100 is provided with a stop-time counter value calculation unit 104 that calculates the stop-time counter value VCAst using the swing-back amount $\alpha$.

Routine calculating the stop-time counter value VCAst executed by the estimation unit 105 and the stop-time counter value calculation unit 104 will be described with reference to FIG. 12. The routine is executed by the controller 100 at the time when the engine operation is stopped.

Figure 12:
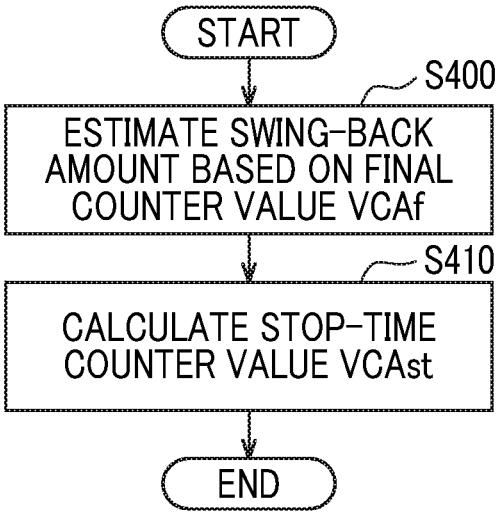
FIG. 12 is a flowchart showing a flow of processing in routine calculating a stop-time counter value.

As shown in FIG. 12, when the routine is started, the swing-back amount $\alpha$ is estimated based on a final counter value VCAf in the processing of step S400. In addition, the final counter value VCAf is the value of the crank counter VCA calculated last by the crank counter calculation unit 103 before the crankshaft 18 stops. In a case where the fuel injection and ignition are stopped at the time when the engine operation is stopped, the rotation speed of the crankshaft 18 is reduced to a minimum. Thereafter, the crankshaft 18 turns in the reverse rotation direction due to the swing-back by the force of the air compressed in a cylinder to recover. Based on the crank angle signal, the crank counter calculation unit 103 specifies the value of the crank counter VCA at the time when the rotation speed of the crankshaft 18 is reduced to a minimum after the fuel injection and ignition are ended, and stores the value in the storage unit 102 as the final counter value VCAf.

A magnitude of the final counter value VCAf indicates the compression state of the air contained in the cylinder, and thus the final counter value VCAf has a high correlation with the swing-back amount $\alpha$. The storage unit 102 stores a second map in which the final counter value VCAf is associated with the swing-back amount $\alpha$. Further, the second map can be created by specifying the swing-back amount $\alpha$ corresponding to the final counter value VCAf by a simulation or an experiment performed in advance. The swing-back amount $\alpha$ stored in the second map is a rotation angle in the reverse rotation direction and is represented as a crank angle.

In the processing of step S400, the estimation unit 105 reads the final counter value VCAf stored in the storage unit 102, and estimates the swing-back amount $\alpha$ with reference to the second map based on the final counter value VCAf. When the swing-back amount $\alpha$ is calculated in the processing of step S400, the controller 100 causes the processing to proceed to step S410.

In the processing of step S410, the stop-time counter value calculation unit 104 calculates the stop-time counter value VCAst. Specifically, the stop-time counter value calculation unit 104 calculates the stop-time counter value VCAst from the final counter value VCAf by counting the crank counter back by the count number corresponding to the swing-back amount α. For example, when the final counter value VCAf is "8" and the swing-back amount α is 60° CA, the stop-time counter value VCAst is set to "6" obtained by counting the crank counter back by two that is a count number corresponding to 60° CA.

When the stop-time counter value VCAst is calculated in this way, the controller 100 ends the routine and causes the storage unit 102 to store the calculated stop-time counter value VCAst. In a case where the swing-back amount α estimated by the estimation unit 105 deviates from the actual swing-back amount, the stop-time counter value VCAst calculated by the stop-time counter value calculation unit 104 also deviates from the value indicating the crank angle at which the crankshaft 18 is actually stopped.

Therefore, as shown in FIG. 1, the controller 100 is provided with a second number of driving times calculation unit 108 that calculates the number of pump driving times NP by a method that does not use the swing-back amount α. In the controller 100, a correction unit 106 corrects the swing-back amount α based on a comparison between the number of pump driving times NP calculated by the second number of driving times calculation unit 108 and the number of pump driving times NP calculated by the first number of driving times calculation unit 107. That is, the controller 100 corrects the swing-back amount α calculated according to the final counter value VCAf by feedback control based on a comparison of calculation results calculated in different aspects.

Therefore, in the controller 100, the count processing by the second number of driving times calculation unit 108 is performed in parallel with the count processing by the first number of driving times calculation unit 107 described above. Hereinafter, a calculation aspect by the first number of driving times calculation unit 107 is referred to as a first aspect, and a calculation aspect by the second number of driving times calculation unit 108 is referred to as a second aspect.

Next, the count processing by the second number of driving times calculation unit 108, that is, the second aspect will be described with reference to FIG. 13. The second number of driving times calculation unit 108 repeatedly executes the count processing shown in FIG. 13 when the count processing by the first number of driving times calculation unit 107 is performed.

Figure 13:
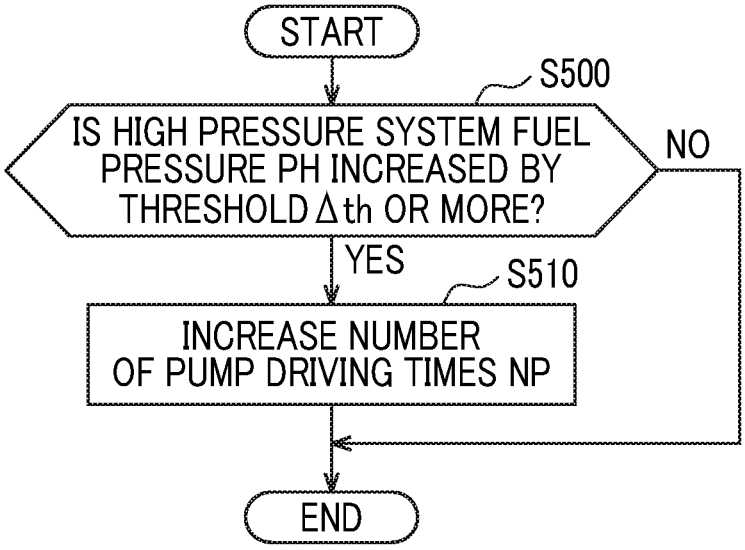
FIG. 13 is a flowchart showing a flow of processing in routine counting the number of pump driving times using high pressure system fuel pressure.

As shown in FIG. 13, when the count processing is started, the second number of driving times calculation unit 108 determines whether or not the high pressure system fuel pressure PH has increased by a threshold Δth or more in the processing of step S500.

Figure 14:
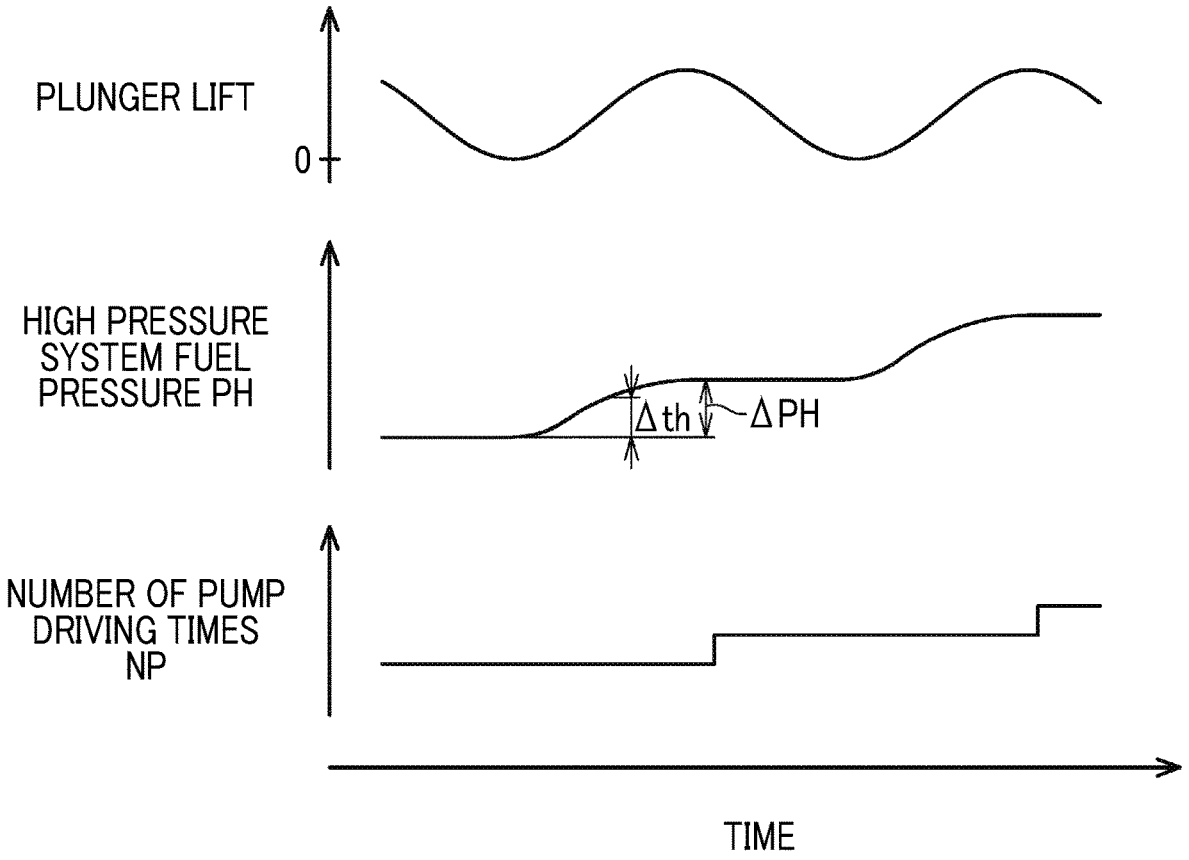
FIG. 14 is a timing chart showing changes in lift amount of the plunger, a high pressure system fuel pressure, and the number of pump driving times.

In the high pressure fuel pump 60, as shown in FIG. 14, the fuel is discharged when the plunger 62 rises, and the high pressure system fuel pressure PH increases. The second number of driving times calculation unit 108 monitors the high pressure system fuel pressure PH, and determines that the high pressure system fuel pressure PH has increased by the threshold value Δth or more when an increase width ΔPH is equal to or more than the threshold value Δth. In addition, the threshold value Δth is set to a size that can determine that the high pressure fuel pump 60 is normally driven and the fuel is discharged based on the fact that the increase width ΔPH is equal to or more than the threshold value Δth.

when the processing of step S500 determines that the high pressure system fuel pressure PH has increased by the threshold value Δth or more (step S500: YES), the second number of driving times calculation unit 108 causes the processing to proceed to step S510. Then, in the processing of step S510, the second number of driving times calculation unit 108 increases the number of pump driving times NP by one. Then, the second number of driving times calculation unit 108 temporarily ends the routine.

On the other hand, when the processing of step S500 determines that the high pressure system fuel pressure PH has not increased by the threshold value Δth or more (step S500: NO), the second number of driving times calculation unit 108 does not execute the processing of step S510, and temporarily ends the routine as it is. That is, at this time, the number of pump driving times NP is not increased and is maintained as the value is.

In this way, in the count processing by the second number of driving times calculation unit 108, as shown in FIG. 14, the number of pump driving times NP is calculated by increasing the number of pump driving times NP under the condition that the increase width ΔPH of the high pressure system fuel pressure PH is equal to or more than the threshold value Δth.

Figure 15:
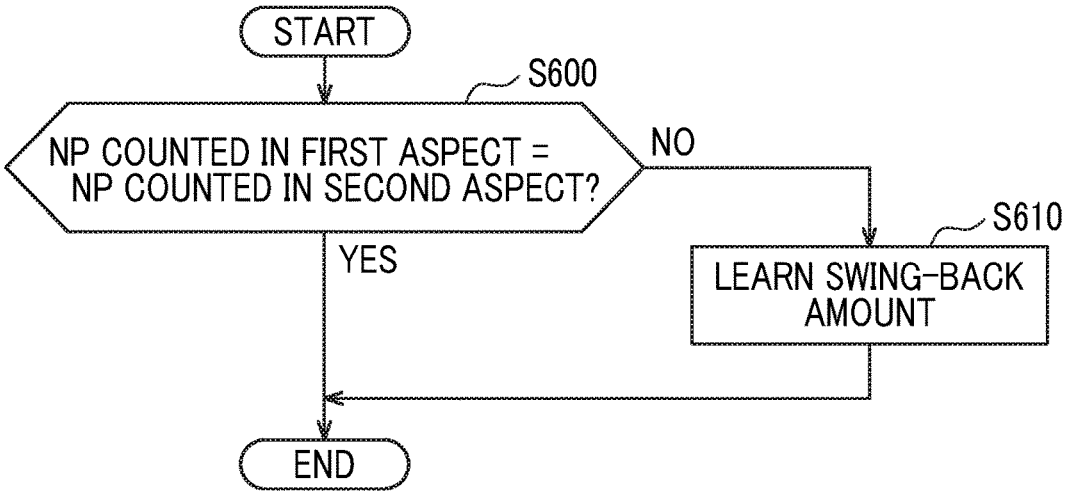
FIG. 15 is a flowchart showing a flow of a series of processing in routine learning the swing-back amount.

Next, the correction of the swing-back amount α executed by the correction unit 106 will be described with reference to FIG. 15 and FIG. 16. FIG. 15 shows a flow of processing in routine executed by the correction unit 106. The routine is executed by the correction unit 106 at the time when the start of the engine is completed.

As shown in FIG. 15, when the routine is started, the correction unit 106 determines whether or not the number of pump driving times NP counted in the first aspect in the processing of step S600 is equal to the number of pump driving times NP counted in the second aspect. That is, here, the correction unit 106 determines whether or not the number of pump driving times NP counted by the first number of driving times calculation unit 107 until the engine start is completed is equal to the number of pump driving times NP counted by the second number of driving times calculation unit 108 during the same period.

When the processing of step S600 determines that the number of pump driving times NP counted in the first aspect is equal to the number of pump driving times NP counted in the second aspect (step S600: YES), the correction unit 106 ends the routine as it is.

On the other hand, when the processing of step S600 determines that the number of pump driving times NP counted in the first aspect is not equal to the number of pump driving times NP counted in the second aspect (step S600: NO), the correction unit 106 causes the processing to proceed to step S610.

Then, the correction unit 106 learns the swing-back amount in the processing of step S610. In the processing of step S620, the correction unit 106 learns the swing-back amount α associated with the final counter value VCAf by correcting the second map such that a difference between the number of pump driving times NP calculated in the first aspect and the number of pump driving times NP calculated in the second aspect is eliminated. Accordingly, the swing-back amount α estimated next time by the estimation unit 105 with reference to the second map is corrected by the correction unit 106. In short, the swing-back amount α used for calculating the stop-time counter value VCAst is corrected.

The correction of the second map in step S610 is performed by the amount needed to eliminate the difference in the calculation result of the number of pump driving times NP. This will be specifically described with reference to FIG. 16. In FIG. 16, a change of the number of pump driving times NP calculated in the second aspect is shown by a solid line, and a change of the number of pump driving times NP calculated in the first aspect is shown by a broken line.

Figure 16:
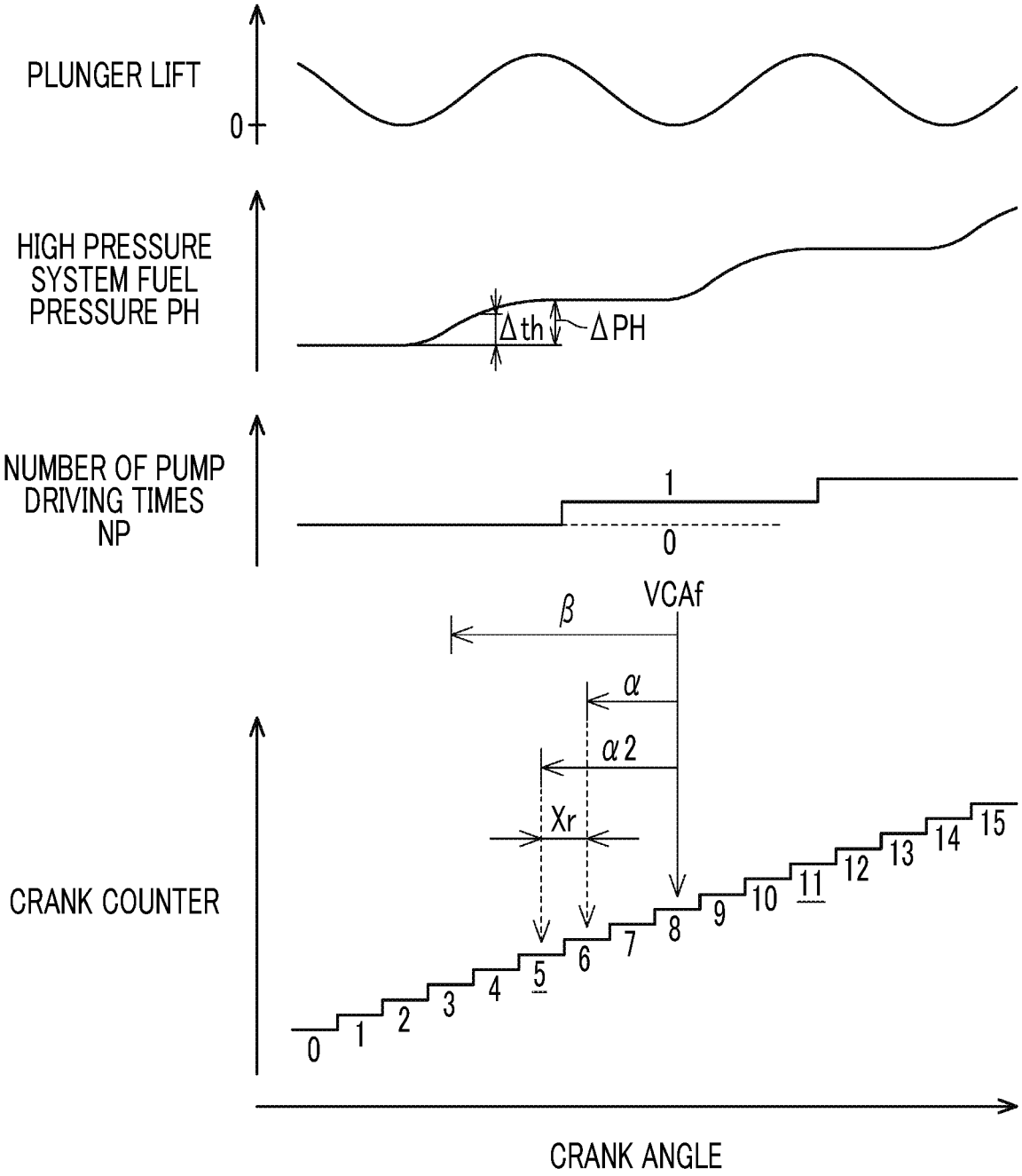
FIG. 16 is an explanatory diagram describing a correction amount correcting the swing-back amount.

As shown in FIG. 16, when the number of pump driving times NP calculated in the first aspect is less than the number of pump driving times NP calculated in the second aspect, the swing-back amount estimated by the estimation unit 105 may have been too small. As shown in FIG. 16, when the actual swing-back amount is "β", the correct stop-time counter value VCAst is "3", but the stop-time counter value VCAst is calculated to be "6" since the swing-back amount α estimated by the estimation unit 105 is too small.

As a result, in the count processing according to the second aspect, the crank counter is counted up based on the fact that the increase width ΔPH of the high pressure system fuel pressure PH is equal to or more than the threshold value Δth, whereas in the count processing according to the first aspect, the count-up is not performed, and a difference occurs in the number of pump driving times NP. In the count processing according to the first aspect, the swing-back amount α needs to be increased such that one count-up is performed to eliminate the difference.

As shown in FIG. 16, in a case where the swing-back amount is increased to "α2" and the stop-time counter value VCAst calculated by the stop-time counter value calculation unit 104 is corrected to be "5" corresponding to the pump TDC, one count-up is performed in the count processing according to the first aspect, and the difference in the number of pump driving times NP does not occur.

Therefore, in this case, learning to correct the second map is performed such that the stop-time counter value VCAst calculated by the stop-time counter value calculation unit 104 becomes "5" corresponding to the pump TDC. That is, as shown in FIG. 16, a correction amount Xr at this time is 30° CA corresponding to one count in the crank counter. The correction unit 106 performs a correction to increase the swing-back amount α stored in the second map by the correction amount Xr.

In addition, when the number of pump driving times NP calculated in the first aspect is more than the number of pump driving times NP calculated in the second aspect, the swing-back amount estimated by the estimation unit 105 may have been too large. Therefore, in that case, similarly to the above, a correction is performed to reduce the swing-back amount α stored in the second map by an amount needed to eliminate the difference in the number of pump driving times NP.

Then, when the swing-back amount is learned in the processing of step S610, the correction unit 106 ends the processing. The action of the present embodiment will be described.

In the controller 100, based on the difference between the number of pump driving times NP calculated by the first number of driving times calculation unit 107 and the number of pump driving times NP calculated by the second number of driving times calculation unit 108, the correction unit 106 corrects the swing-back amount α used for calculating the stop-time counter value VCAst. That is, in the controller 100, the calculation result of the first number of driving times calculation unit 107 that calculates the number of pump driving times NP using stop-time counter value VCAst and the calculation result of the second number of driving times calculation unit 108 that calculates the number of pump driving times NP without using the stop-time counter value VCAst are compared. Then, based on the result, feedback control is executed to correct the swing-back amount α used for calculating the stop-time counter value VCAst.

In addition, when the correction is performed by the feedback control, the controller 100 corrects the swing-back amount stored in the second map by an amount needed to eliminate the difference in the number of pump driving times NP.

The effect of the present embodiment will be described. Since the swing-back amount is corrected based on a comparison between the calculation result of the number of pump driving times NP calculated in the first aspect and the number of pump driving times NP calculated in the second aspect, it is possible to suppress a situation in which the control is continued with the difference between the swing-back amount α used for calculating the stop-time counter value VCAst and the actual swing-back amount.

The correction unit 106 reduces the swing-back amount α used for calculating the stop-time counter value VCAst when the number of pump driving times NP calculated by the first number of driving times calculation unit 107 is more than the number of pump driving times NP calculated by the second number of driving times calculation unit 108 based on the high pressure system fuel pressure PH. Therefore, it is possible to suppress continuance of a situation where the swing-back amount α used for calculating the stop-time counter value VCAst is too large.

The correction unit 106 increases the swing-back amount α used for calculating the stop-time counter value VCAst when the number of pump driving times NP calculated by the first number of driving times calculation unit 107 is less than the number of pump driving times NP calculated by the second number of driving times calculation unit 108 based on the high pressure system fuel pressure PH. Therefore, it is possible to suppress continuance of a situation where the swing-back amount α used for calculating the stop-time counter value VCAst is too small.

In the controller 100, a correction is performed in accordance with the amount needed to eliminate the difference in the calculation result of the number of pump driving times NP, and the correction amount is kept to a needed minimum range. Therefore, according to the above configuration, the difference between the number of pump driving times NP calculated by the first number of driving times calculation unit 107 and the number of pump driving times NP calculated by the second number of driving times calculation unit 108 can be eliminated while excessive correction is suppressed.

A magnitude of the final counter value VCAf which is the value of the crank counter calculated last before the crankshaft 18 stops indicates the compression state of the air contained in the cylinder, and thus has a high correlation with the swing-back amount. Therefore, when the second map in which the final counter value VCAf is associated with the swing-back amount is stored in the storage unit 102 as in the above configuration, the swing-back amount α can be estimated based on the final counter value VCAf with reference to the second map.

The swing-back amount α estimated by the estimation unit 105 is corrected by correcting the second map, and the swing-back amount α used for calculating the stop-time counter value VCAst is corrected.

In the controller 100, since the number of pump driving times NP counted from the value of the crank counter VCA is calculated, even when an abnormality occurs in the high pressure system fuel pressure sensor 185 and the number of pump driving times NP due to a change in the high pressure system fuel pressure PH cannot be calculated, the number of pump driving times NP counted from the value of the crank counter VCA can be used. Further, as described above, since feedback is performed by comparing the calculation results of the number of pump driving times NP according to two different aspects, it is possible to more accurately calculate the number of pump driving times NP than when the aspect counted from the value of the crank counter VCA is applied solely.

The present embodiment can be implemented with the following modifications. The present embodiment and the following modification examples can be implemented in combination with each other as long as there is no technical contradiction. In the above-described embodiment, the internal combustion engine 10 in which the pump cam 67 is attached to the intake camshaft 25 has been illustrated. However, the configuration for calculating the number of pump driving times NP as in the above embodiment is not limited to the internal combustion engine in which the pump cam 67 is driven by the intake camshaft. For example, the present disclosure can be applied to an internal combustion engine in which the pump cam 67 is attached to the exhaust camshaft 26. Further, the present embodiment can be similarly applied to an internal combustion engine in which the pump cam 67 rotates in conjunction with the rotation of the crankshaft 18. Therefore, the controller can be applied to the internal combustion engine in which the pump cam 67 is attached to the crankshaft 18 or the internal combustion engine having the pump camshaft that rotates in conjunction with the crankshaft 18.

When the temperature of the internal combustion engine 10 is low, a viscosity of a lubricating oil is high, and friction when the crankshaft 18 rotates is large. Therefore, the swing-back amount α tends to be small. Accordingly, when the coolant temperature THW is low, the swing-back amount α used for calculating the stop-time counter value VCAst may be further reduced. By adopting such a configuration, the deviation from the actual swing-back amount can be further suppressed, and the stop-time counter value VCAst can be calculated more accurately.

In the above-described embodiment, although the example of correcting the swing-back amount has been described, the method of correcting the swing-back amount used for calculating the stop-time counter value VCAst by performing the learning to correct the second map by the correction unit 106 is not limited to such a method. For example, instead of correcting the second map, the estimated swing-back amount a may be corrected after the estimation unit 105 estimates the swing-back amount α with reference to the second map.

Figure 17:
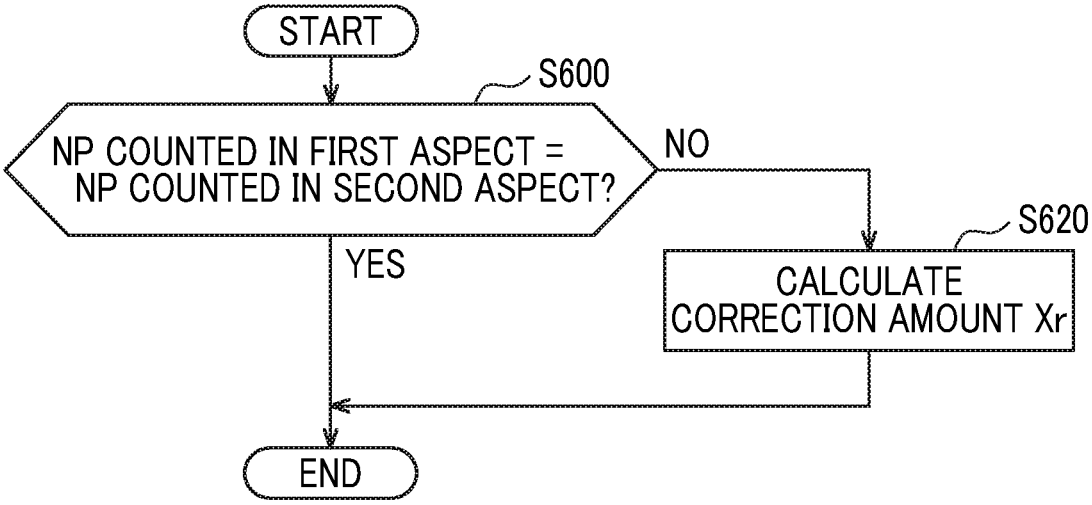
FIG. 17 is a flowchart showing a flow of processing of routine calculating a correction amount executed in the controller of the modification examples.
Figure 18:
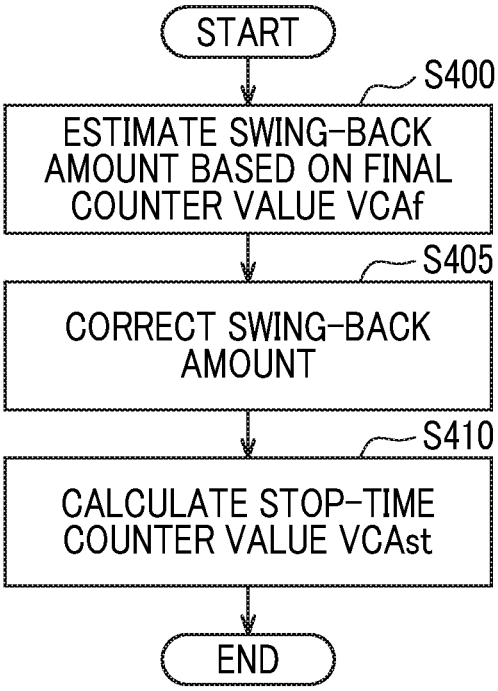
FIG. 18 is a flowchart showing a flow of processing of routine calculating a stop-time counter value executed in the controller of the modification examples.

In this case, the correction unit 106 executes the processing of step S620 calculating the correction amount Xr instead of the processing of step S610 as shown in FIG. 17. Then, as shown in FIG. 18, after the processing in step S400, the correction unit 106 executes the processing in step S405 in which the swing-back amount α is corrected by the correction amount Xr. Using the swing-back amount α corrected by the correction unit 106 in this way, the stop-time counter value calculation unit 104 calculates the stop-time counter value VCAst in the processing of step S410.

As in the above-described embodiment even when such a configuration is adopted, the difference between the swing-back amount α used for calculating the stop-time counter value VCAst and the actual swing-back amount can be eliminated. In the above-described embodiment, the example in which the swing-back amount α is estimated based on the final counter value VCAf has been described. However, the method of estimating the swing-back amount α by the estimation unit 105 is not limited to such a method. For example, as in JP 2013-092116 A, a method in which the swing-back amount is estimated with reference to reverse flow air amount and the stop-time counter value VCAst is calculated from the final counter value VCAf and the estimated swing-back amount can also be considered. Even in the configuration adopting such a method, it is possible to suppress the deviation of the swing-back amount used for calculating the stop-time counter value VCAst by comparing the number of pump driving times NP calculated in the aspect using the estimated swing-back amount with the number of pump driving times NP calculated by the second aspect without using the swing-back amount and correcting the swing amount.

Since the value of the crank counter VCA directly corresponds to the turning amount of the crankshaft 18, the aspect of the above-described embodiment in which the swing-back amount is estimated using the value of the crank counter VCA tends to be more advantageous than the aspect in which the swing-back amount is estimated based on the reverse flow air amount detected by the air flow meter in increasing the calculation precision.

Although the example in which the swing-back amount is represented by the rotation angle has been described, the swing-back amount does not have to be the rotation angle. For example, the swing-back amount may be indicated by a count number in the crank counter. In addition, in this case, the estimated swing-back amount is the count number. Therefore, in this case, the stop-time counter value VCAst is calculated by counting the crank counter back by the count number corresponding to the swing-back amount from the final counter value VCAf.

The above-described embodiment describes the example in which the correction amount is determined in accordance with the amount needed to eliminate the difference in the number of pump driving times NP, and the correction is performed in accordance with the needed amount, but the amount of correction does not have to be variable in this way. For example, each time a negative determination is made in the processing of step S600 (step S600: NO), the swing-back amount may be corrected by a fixed amount. Further, the correction does not have to be repeated, and the correction may be performed once. In a case where the difference is smaller than before the correction by performing the correction, there is an effect of suppressing the adverse effect due to the deviation of the swing-back amount as compared with when the correction is not performed.

Any one of the correction to reduce the swing-back amount used for calculating the stop-time counter value VCAst and the correction to increase the swing-back amount used for calculating the stop-time counter value VCAst may be performed. For example, when a design is made such that the second map is corrected in a direction that the swing-back amount is gradually reduced by a fixed amount, and the deviation gradually is eliminated, the configuration that performs correction to increase the swing-back amount does not have to be included.

In the above-described embodiment, an example in which the number of pump driving times NP is used to determine whether or not to perform the engine start by the in-cylinder fuel injection has been described. However, the usage aspect of the number of pump driving times NP is not limited to such an aspect. For example, the high pressure system fuel pressure PH may be estimated using the number of pump driving times NP. In this case, as shown by a two-dot chain line in FIG. 1, the controller 100 is provided with a fuel pressure estimation unit 109. Then, the fuel pressure estimation unit 109 of the controller 100 estimates the high pressure system fuel pressure PH based on the number of pump driving times NP calculated by the first number of driving times calculation unit 107. Specifically, the fuel pressure estimation unit 109 estimates that the higher the number of pump driving times NP, the higher the high pressure system fuel pressure PH.

The fact that the number of pump driving times NP is large means that the amount of the fuel delivered from the high pressure fuel pump 60 is large, and thus, the number of pump driving times NP is correlated with the high pressure system fuel pressure PH. Accordingly, as described above, the high pressure system fuel pressure PH can be estimated based on the calculated number of pump driving times NP. According to such a configuration, for example, even when the high pressure system fuel pressure sensor 185 that detects the high pressure system fuel pressure PH has an abnormality, a control based on an estimated high pressure system fuel pressure PH can be performed.

When the high pressure system fuel pressure PH is estimated based on the number of pump driving times NP as described above, the fuel injection from the in-cylinder fuel injection valve 15 can be started, and the start by the in-cylinder fuel injection can be performed when the estimated high pressure system fuel pressure PH is equal to or more than the specified pressure PHth. That is, in the processing of step S130, the controller 100 may determine whether or not the high pressure system fuel pressure PH estimated by the fuel pressure estimation unit 109 is equal to or more than the specified pressure PHth.

According to such a configuration, the fuel injection of the in-cylinder fuel injection valve 15 is started when it is estimated that the high pressure system fuel pressure PH estimated based on the calculated number of pump driving times NP is equal to or more than the specified pressure PHth and the high pressure system fuel pressure PH is high. Therefore, as with the above-described embodiment, it is possible to suppress in-cylinder fuel injection from being performed while the high pressure system fuel pressure PH is low.

In addition, the usage aspect of the estimated high pressure system fuel pressure PH is not limited to the usage aspect described above. For example, an opening period of the in-cylinder fuel injection valve 15, that is, fuel injection time may be set according to a target injection amount based on the estimated high pressure system fuel pressure PH.

As the first map referred to by the first number of driving times calculation unit 107, the first map storing information for four rotations of the crankshaft 18 is stored in the storage unit 102, and the first map is used even when the value of the crank counter VCA is reset halfway, and thereby an example in which the number of pump driving times NP can be calculated is described. However, the method of calculating the number of pump driving times NP is not limited to such a method.

For example, even when the first map for two rotations of the crankshaft 18 is stored in the storage unit 102, the number of pump driving times NP can be calculated. Specifically, when the identified value of the crank counter VCA is less than the stop-time counter value VCAst, in the count processing, the number of value of the crank counters corresponding to the pump TDC separately between the stop-time counter value VCAst to "23" and between "0" to the identified value of the crank counter VCA may be searched. Also, in this case, the number of pump driving times NP can be calculated by adding the searched numbers to the number of pump driving times NP.

The aspect of updating the number of pump driving times NP in the count processing executed by the first number of driving times calculation unit 107 after the value of the crank counter VCA is identified is not limited to the aspect shown in the above-described embodiment. For example, each time the value of the crank counter VCA is updated a fixed number of times, it is also possible to calculate how many times the crank angle corresponding to the pump TDC has been passed with reference to the first map, and to update the number of pump driving times NP by integrating the calculated number of times.

Although the example in which the internal combustion engine 10 includes the in-cylinder fuel injection valve 15 and the port injection valve 14 has been described, the internal combustion engine 10 may include solely the in-cylinder fuel injection valve 15, that is, solely the high pressure-side fuel supply system 51.

Although the example in which the internal combustion engine 10 includes the intake-side variable valve timing mechanism 27 and the exhaust-side variable valve timing mechanism 28 has been described, the configuration for calculating the number of pump driving times NP as described above can also be applied to internal combustion engines that does not have a variable valve timing mechanism.

Specifically, even when the internal combustion engine has a configuration that includes solely the intake-side variable valve timing mechanism 27, a configuration that includes solely the exhaust-side variable valve timing mechanism 28, and a configuration that does not include the variable valve timing mechanism, the configuration for calculating the number of pump driving times NP as described above can be applied.

A representation of the value of the crank counter VCA is not limited to one that counts up one by one such as "1", "2", "3", . . . . For example, the expression may be counted up by 30 such as "0", "30", "60", . . . in accordance with the corresponding crank angle. Of course, the expression may not have to be counted up by 30 as in the crank angle. For example, the expression may be counted up by 5 such as "0", "5", "10", . . . .

Although the example in which the value of the crank counter VCA is counted up every 30° CA has been described, the method of counting up the value of the crank counter VCA is not limited to the aspect. For example, a configuration that counts up every 10° CA may be adopted, or a configuration that counts up at intervals longer than 30° CA may be adopted. That is, a configuration in which the crank counter is counted up each time three edges are counted, and the crank counter is counted up every 30° CA is adopted in the above-described embodiment. However, the number of edges needed for counting up may be changed appropriately. For example, a configuration in which the crank counter is counted up each time one edge is counted, and the crank counter is counted up every 10° CA can be also adopted.

What is claimed is:

1. A control system for an internal combustion engine including a high pressure fuel pump in which a volume of a fuel chamber is increased and is decreased and a fuel is pressurized by a reciprocating motion of a plunger due to an action of a pump cam that rotates in conjunction with a rotation of a crankshaft, and an in-cylinder fuel injection valve which injects the fuel into a cylinder, the control system comprising a controller configured to calculate a crank counter that is counted up at every fixed crank angle when the crankshaft is rotating in a forward rotation direction, estimate a swing-back amount indicating a turning amount of the crankshaft in a reverse rotation direction until the crankshaft stops, calculate a stop-time counter value which is a value of the crank counter at the time when the internal combustion engine is stopped based on a final counter value which is the value of the crank counter calculated last before the crankshaft stops and the estimated swing-back amount, store a map in which a top dead center of the plunger is associated with the value of the crank counter, calculate the number of driving times of the high pressure fuel pump with reference to the map based on the calculated stop-time counter value and the value of the crank counter, calculate the number of driving times of the high pressure fuel pump by increasing the number of driving times by one each time a high pressure system fuel pressure which is a pressure of the fuel supplied to the in-cylinder fuel injection valve increases by a threshold or more, and correct the swing-back amount used for calculating the stop-time counter value based on a difference between the number of driving times calculated based on the calculated stop-time counter value and the value of the crank counter and the number of driving times calculated by increasing the number of driving times by one each time the high pressure system fuel pressure increases by the threshold or more.

2. The control system according to claim 1, wherein the controller is configured to further reduce the swing-back amount used for calculating the stop-time counter value when the number of driving times calculated based on the calculated stop-time counter value and the value of the crank counter is more than the number of driving times calculated by increasing the number of driving times by one each time the high pressure system fuel pressure increases by the threshold or more.

3. The control system according to claim 1, wherein the controller is configured to further increase the swing-back amount used for calculating the stop-time counter value when the number of driving times calculated based on the calculated stop-time counter value and the value of the crank counter is less than the number of driving times calculated by increasing the number of driving times by one each time the high pressure system fuel pressure increases by the threshold or more.

4. The control system according to claim 2, wherein the controller is configured to correct the swing-back amount used for calculating the stop-time counter value by an amount needed to eliminate the difference between the number of driving times calculated based on the calculated stop-time counter value and the value of the crank counter and the number of driving times calculated by increasing the number of driving times by one each time the high pressure system fuel pressure increases by the threshold or more.

5. The control system according to claim 1, wherein:

the controller is configured to have a first map in which the top dead center of the plunger is associated with the value of the crank counter and a second map in which the final counter value is associated with the swing-back amount; and the controller is configured to estimate the swing-back amount based on the final counter value with reference to the second map, and corrects the swing-back amount estimated by correcting the second map.

6. An internal combustion engine comprising:

a high pressure fuel pump in which a volume of a fuel chamber is increased and is decreased and a fuel is pressurized by a reciprocating motion of a plunger due to an action of a pump cam that rotates in conjunction with a rotation of a crankshaft;

an in-cylinder fuel injection valve which injects the fuel into a cylinder; and a controller configured to calculate a crank counter that is counted up at every fixed crank angle when the crankshaft is rotating in a forward rotation direction;

estimate a swing-back amount indicating a turning amount of the crankshaft in a reverse rotation direction until the crankshaft stops;

calculate a stop-time counter value which is a value of the crank counter at the time when the internal combustion engine is stopped based on a final counter value which is the value of the crank counter calculated last before the crankshaft stops and the estimated swing-back amount;

store a map in which a top dead center of the plunger is associated with the value of the crank counter;

calculate the number of driving times of the high pressure fuel pump with reference to the map based on the calculated stop-time counter value and the value of the crank counter;

calculate the number of driving times of the high pressure fuel pump by increasing the number of driving times by one each time a high pressure system fuel pressure which is a pressure of the fuel supplied to the in-cylinder fuel injection valve increases by a threshold or more; and correct the swing-back amount used for calculating the stop-time counter value based on a difference between the number of driving times calculated based on the calculated stop-time counter value and the value of the crank counter and the number of driving times calculated by increasing the number of driving times by one each time the high pressure system fuel pressure increases by the threshold or more.

* * * * *